United States Patent [19]

Riley et al.

[11] 4,121,818

[45] Oct. 24, 1978

[54] SIGNATURE COLLATING AND BINDING SYSTEM

[75] Inventors: Wayne A. Riley, Hazelcrest; Melinda S. Ingebretsen, Downers Grove; Robert I. Rodig, Barrington; David V. Krapf, South Holland; Donald E. Hagenbart, Oak Forest; Charles H. Williams, Chicago, all of Ill.

[73] Assignee: R. R. Donnelley & Sons Co., Chicago, Ill.

[21] Appl. No.: 856,911

[22] Filed: Dec. 2, 1977

Related U.S. Application Data

[63] Continuation of Ser. No. 709,492, Jul. 28, 1976, abandoned.

[51] Int. Cl.[2] ..... B65H 39/02

[52] U.S. Cl. ..... 270/54; 270/58

[58] Field of Search ..... 270/1, 4, 12, 18, 52, 270/54–58

[56] References Cited

U.S. PATENT DOCUMENTS

| | | | |
|---|---|---|---|
| 3,819,173 | 6/1974 | Anderson | 270/54 |
| 3,899,165 | 8/1975 | Abram | 270/54 |
| 3,902,708 | 9/1975 | Wise | 270/58 |
| 3,917,252 | 11/1975 | Harder | 270/58 |
| 3,953,017 | 4/1976 | Wise | 270/54 |
| 3,982,744 | 9/1976 | Kraynak | 270/54 |

*Primary Examiner*—Edgar S. Burr
*Assistant Examiner*—A. Heinz
*Attorney, Agent, or Firm*—Wegner, Stellman, McCord, Wiles & Wood

[57] ABSTRACT

Each signature feeder along a collating conveyor is selectively actuated under control of coded signals containing mailing information. A dot matrix printer, located between the feeders, is responsive to the coded signals to selectively print custom information within books of signatures. A second dot matrix printer, located after the stitcher and trimmer, prints mailing labels under control of the coded signals. Optical scanners located downstream of the dot matrix printers scan each line of possible printing to detect printing errors. A replacement book feeder, which inserts standard replacement books to fill empty spaces left by rejected books, has a hopper which is automatically refilled by diverting books of signatures from the conveyor. The entire collating line is controlled by a programmable controller and a computer which also reorders or replaces defective books of signatures, compensates for variations in calipered signature thicknesses, and controls other special handling procedures.

31 Claims, 23 Drawing Figures

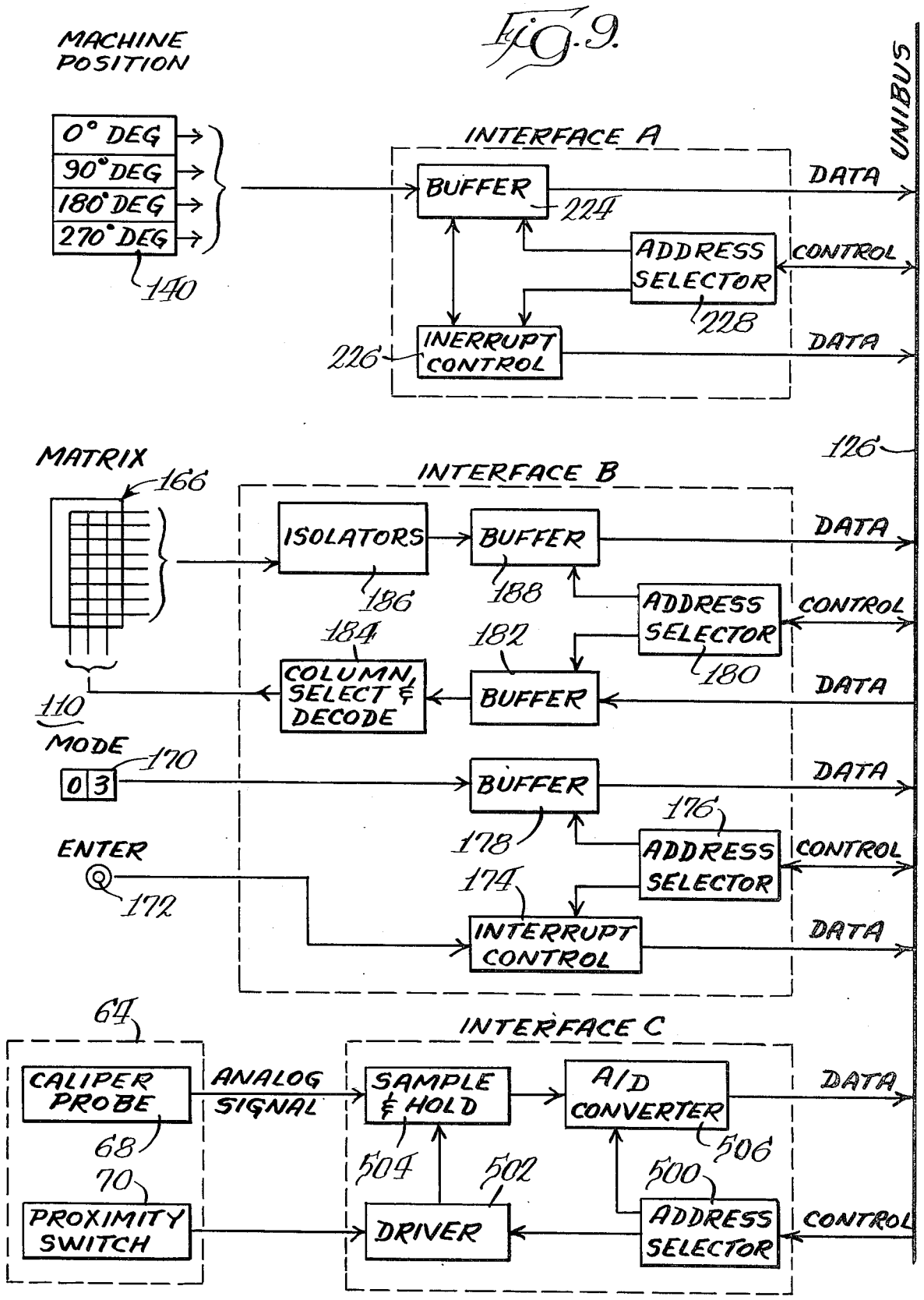
Fig. 9.
MACHINE POSITION
0° DEG
90° DEG
180° DEG
270° DEG
140
INTERFACE A
BUFFER
224
ADDRESS SELECTOR
228
INERRUPT CONTROL
226
DATA
CONTROL
DATA
UNIBUS
126
MATRIX
166
110
INTERFACE B
ISOLATORS
186
BUFFER
188
ADDRESS SELECTOR
180
184
COLUMN, SELECT & DECODE
182
BUFFER
MODE
0 3
170
BUFFER
178
ENTER
172
176
ADDRESS SELECTOR
174
INTERRUPT CONTROL
DATA
CONTROL
DATA
DATA
CONTROL
DATA
64
INTERFACE C
CALIPER PROBE
68
PROXIMITY SWITCH
70
ANALOG SIGNAL
SAMPLE & HOLD
504
A/D CONVERTER
506
DRIVER
502
ADDRESS SELECTOR
500
DATA
CONTROL

RING BUFFER BOOK FORMAT

| | |
|---|---|
| WORD 1 | BOOK MODE |
| 2 | BOOK SEQUENCE NUMBER |
| 3 | BOX 1-16 TO FEED (BIT/BOX) |
| 4 | BOX 17-N TO FEED (BIT/BOX) |
| 5 | EXPECTED BOOK THICKNESS |
| 6 | ACTUAL CALIPER THICKNESS |
| 7 | ERRORS (BIT/ERROR TYPE) |
| | 0: SIG. PRINTER ERROR |
| | 1: MISSING SIGNATURE |
| | 2: LABEL PRINTER ERROR |
| | 3: SPECIAL |
| | 4: CALIPER ERROR |
| | 5: MISSING BOOK |
| | 15: REORDER BOOK |
| 8 | SPECIAL ID |
| 9-163 | NAME, ADDRESS, CITY, STATE |
| 164-168 | ZIP CODE |

START
200
INITIALIZE TABLES, VARIABLES & DEVICES
202
READ MATRIX SET UP TIMING
204
ENABLE INTERRUPTS
MESSAGE PROCESSOR "HOME"
206
ANYTHING TO PRINT ON TTY
208
NO
KEEP TRACK OF IDLE TIME
210
YES
PRINT
212
INTERRUPTS
216
ENCODER
PROGRAMMABLE CONTROLLER MESSAGE
PRINTER
244
OPERATOR MESSAGE
700
MODE SWITCH
POWER FAIL
220
MAG. TAPE

ENCODER
216
VALID FORWARD MOVEMENT
230
NO
RETURN HOME
206
YES
INCREMENT MOVEMENTS TO SERVICE COUNTER
232
218
236
OVERFLOW
YES
PRINT MESSAGE STOP LINE
NO
ANY TASKS TO SERVICE
238
NO
RETURN HOME
206
YES
GET NEXT TASK
240
END OF CYCLE
YES
GO TO TOP OF LIST
NO
END OF LIST
YES
DECREMENT MOVEMENTS TO SERVICE COUNTER
NO
262
DONE ?
YES
206
RETURN HOME
NO
PROCESS NEXT ON LIST
260

BOX X FEED TASK
242
GET BOOK MEMORY ADDRESS
270
IS THERE A REAL BOOK AT BOX
272
NO
RETURN TO TASK ROUTINE
281
YES
ANY ERROR ON BOOK SO FAR
274
YES
NO
SHOULD BOX FEED FOR BOOK
276
NO
WAS IT OFF LAST TIME
282
YES
NO
TURN BOX OFF
YES
ADD CALCULATED THICKNESS TO WORD 5
277
WAS IT ON LAST TIME
278
YES
NO
TURN BOX ON
INCREMENT BOOK MEMORY ADDRESS
280
RETURN TO TASK ROUTINE
281

PRINTER TASK
244
PRINTER FINISH LAST BOOK
410
NO
YES
GET BOOK MEMORY ADDRESS (POINTER)
412
HAS BOOK BEEN REORDERED
418
YES
NO
PRINTING MODE
420
NO
YES
LOAD MEMORY ADDRESS INTO PRINTER COMMUNICATION REGISTER
422
INCREMENT POINTER TO NEXT BOOK MEMORY ADDRESS
424
RETURN TO TASK ROUTINE
281

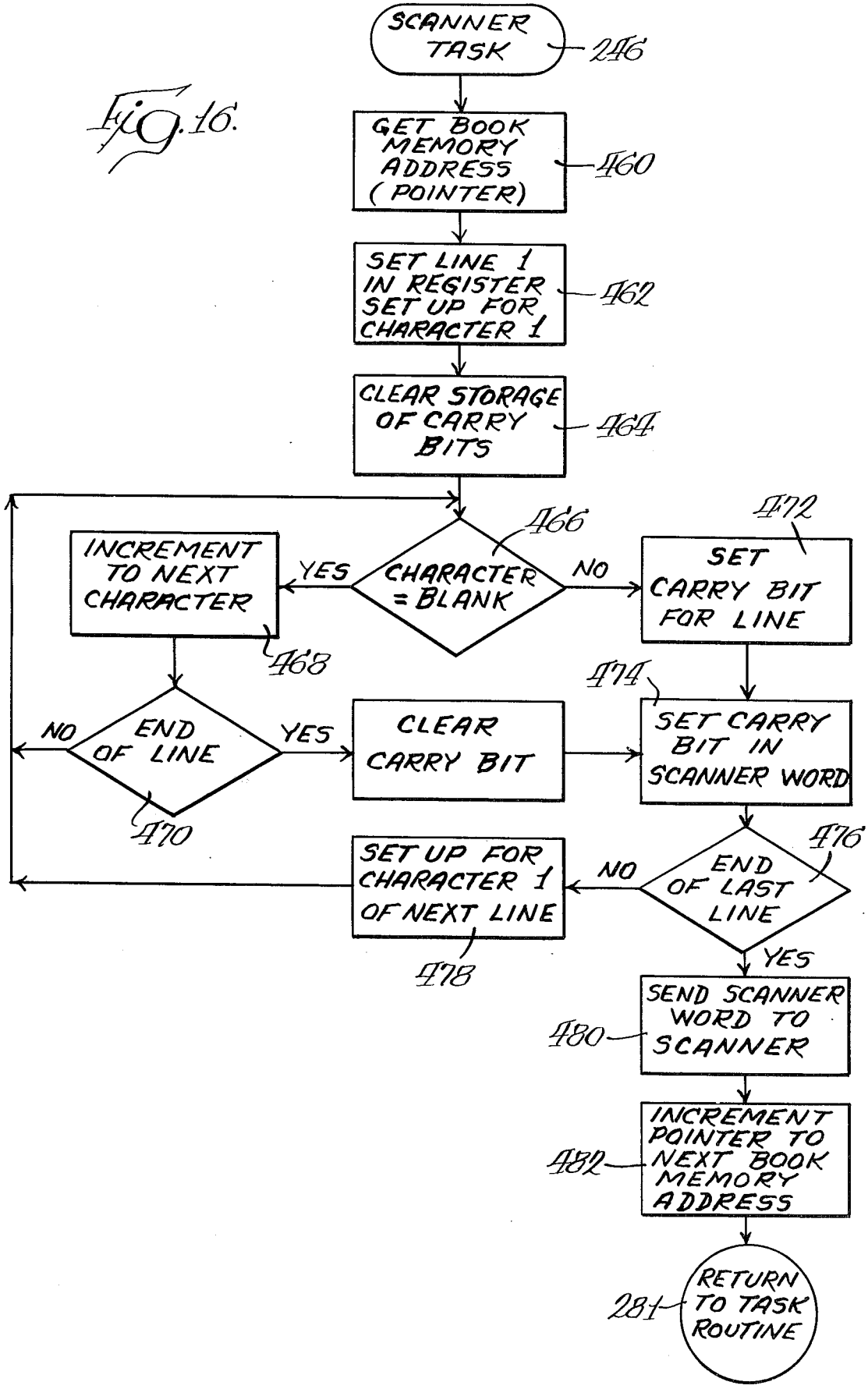
Fig. 16.
SCANNER TASK
246
GET BOOK MEMORY ADDRESS (POINTER)
460
SET LINE 1 IN REGISTER SET UP FOR CHARACTER 1
462
CLEAR STORAGE OF CARRY BITS
464
466
CHARACTER = BLANK
YES
NO
INCREMENT TO NEXT CHARACTER
468
472
SET CARRY BIT FOR LINE
474
SET CARRY BIT IN SCANNER WORD
END OF LINE
NO
YES
470
CLEAR CARRY BIT
476
END OF LAST LINE
NO
YES
SET UP FOR CHARACTER 1 OF NEXT LINE
478
SEND SCANNER WORD TO SCANNER
480
INCREMENT POINTER TO NEXT BOOK MEMORY ADDRESS
482
RETURN TO TASK ROUTINE
284

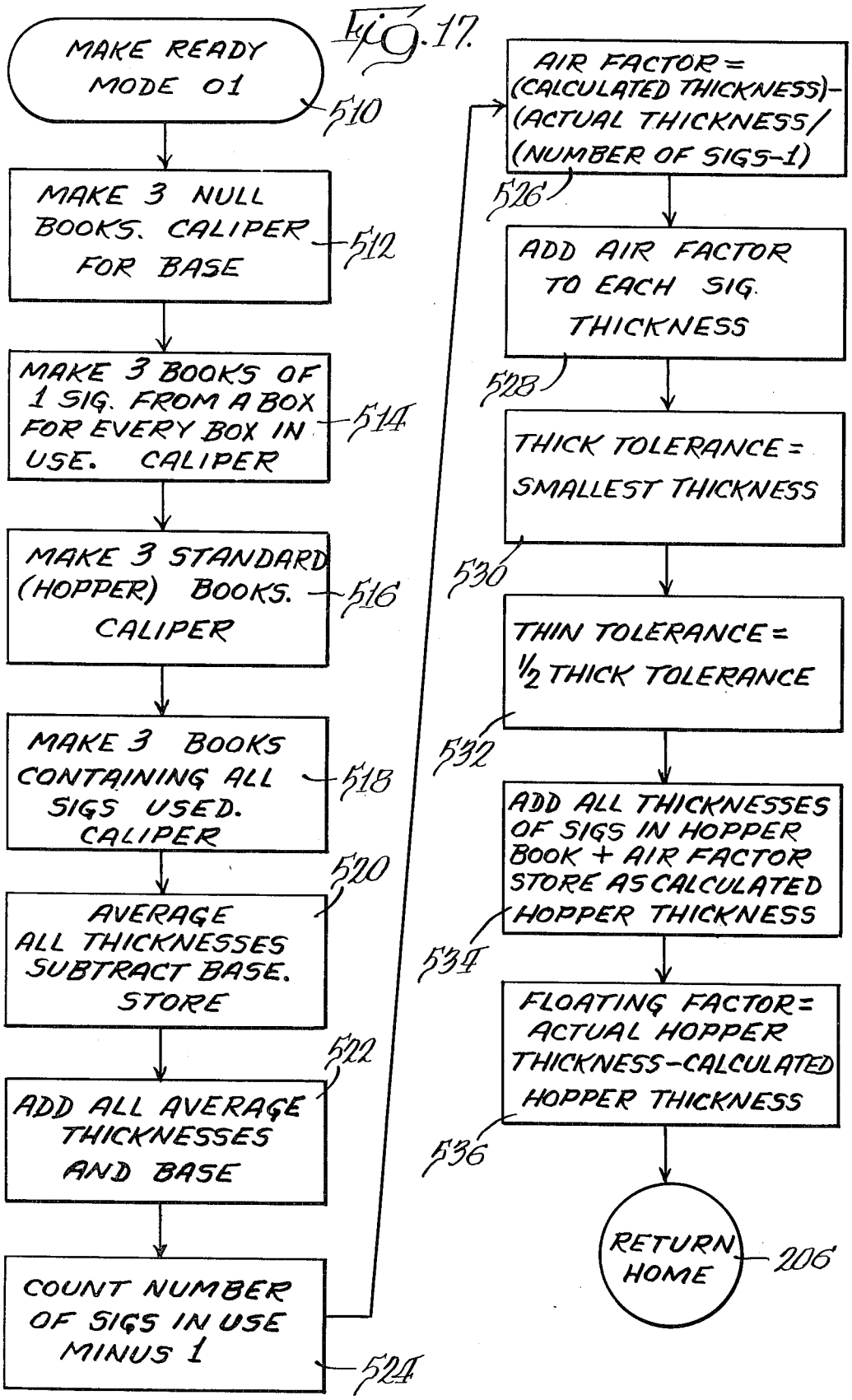
Fig. 17.
MAKE READY MODE 01
510
MAKE 3 NULL BOOKS. CALIPER FOR BASE
512
MAKE 3 BOOKS OF 1 SIG. FROM A BOX FOR EVERY BOX IN USE. CALIPER
514
MAKE 3 STANDARD (HOPPER) BOOKS. CALIPER
516
MAKE 3 BOOKS CONTAINING ALL SIGS USED. CALIPER
518
AVERAGE ALL THICKNESSES SUBTRACT BASE. STORE
520
ADD ALL AVERAGE THICKNESSES AND BASE
522
COUNT NUMBER OF SIGS IN USE MINUS 1
524
AIR FACTOR = (CALCULATED THICKNESS) - (ACTUAL THICKNESS / (NUMBER OF SIGS-1)
526
ADD AIR FACTOR TO EACH SIG. THICKNESS
528
THICK TOLERANCE = SMALLEST THICKNESS
530
THIN TOLERANCE = 1/2 THICK TOLERANCE
532
ADD ALL THICKNESSES OF SIGS IN HOPPER BOOK + AIR FACTOR STORE AS CALCULATED HOPPER THICKNESS
534
FLOATING FACTOR = ACTUAL HOPPER THICKNESS - CALCULATED HOPPER THICKNESS
536
RETURN HOME
206

BOOK KICKER TASK
252
GET BOOK MEMORY ADDRESS
746
IS THERE A REAL BOOK
748
NO
RETURN TO TASK ROUTINE
281
YES
END OF ZIP CODE
750
YES
NO
WAS KICKER ON LAST TIME
752
YES
NO
TURN KICKER ON
754
IS OTHER SPECIAL HANDLING
758
YES
NO
WAS KICKER OFF LAST TIME
760
YES
NO
TURN KICKER OFF
762
INCREMENT BOOK MEMORY ADDRESS
756
RETURN TO TASK ROUTINE
281

SIGNATURE COLLATING AND BINDING SYSTEM

This is a continuation of application Ser. No. 709,492, filed July 28, 1976.

BACKGROUND OF THE INVENTION

This invention relates to a signature collating and binding system with selectively controllable signature feeders, printers, and other apparatus.

Selective actuation of signature feeders by coded subscriber information is a known procedure which allows a single collating and binding system to simultaneously build different versions of a book of signatures, such as different editions of a magazine. A book of signatures, as is conventional, is any collection or group of signatures, each signature being composed of one or more sheets. The thickness of different books of signatures will randomly vary, depending on which feeders or inserters were actuated in response to the special interests of the subscribers. A book thickness caliper and circuit can continuously compare a detected book thickness with the book thickness which should have been selected under control of the coded information. Any error, as detected by the caliper or by sensors at the signature feeders, causes the defective book to be rejected, and a standard replacement book of signatures can be delivered to fill the empty space so as to prevent loss of synchronism with the coded information which also controls a label printer. An example of such a system is disclosed in Abram et al. U.S. Pat. No. 3,899,165 issued Aug. 12, 1975 and assigned to the present assignee.

The mailing labels which are placed on each book of signatures must correspond to the coded information which produced the customized books of signatures. This has been accomplished in the past by reading preprinted labels to develop the coded information, or by storing the coded information on magnetic tape which is read and later controls a printer which prints the mailing information directly on the books of signatures. Printers have also been associated with card inserters, located after the signature feeders and before the stitcher, to print custom information such as renewal information on a loose card before it is inserted in an already constructed book of signatures. The card can be bound in by a paster to prevent its being lost from the book of signatures associated therewith.

Defective books as detected by a caliper or by sensors associated with the signature feeders or other devices along the collating line have been automatically rejected. The resulting empty space on the collating conveyor may be filled, as taught in the Abrams et al. patent, by a replacement book of signatures. In other systems, a rejected book causes a new book of signatures to be automatically reordered. If preprinted labels are utilized, the label is rejected and a different means of printing the mailing label of the reordered book is used, such as an on-line printer. Rejected books can be reordered immediately if the zip code currently being produced can still be maintained; otherwise some special handling procedure is necessary such as to divert the reordered book when it reaches an output area. The entire collating system has been controlled by computers and/or programmable controllers as well as hardwired circuitry.

While the above systems are versatile in producing different editions of magazines or the like during a single production run, they suffer from a number of disadvantages. The contents of the different editions or variations are still controlled entirely by the signature which are loaded in the signature feeders. Since the number of signature feeders reaches a practical maximum, there is a limit to the variations which can be produced in concurrently run books of signatures.

The printing of labels and cards involve adapting conventional printers to the different requirements of a collating line. Often the labels and cards are printed off-line, and are then applied to a book of signatures or inserted therein. If the printer should malfunction, the resulting defective book may be sent out as there has been no error detection means corresponding to the calipers and limit switches which detect other types of errors on the collating line. However, an error in a mailing label can be more serious than an error such as the addition or deletion of a signature from a book of signatures.

Despite the use of computers and programmable controllers, considerable manual attention to the binding line is necessary. As the hoppers for signatures becomes low, they must be filled to allow continuation of the operation. This is especially critical for the standard book replacement feeder, in which the number of replacement books needed cannot be reasonably estimated in advance, as it will vary depending on the number of random rejects which occur during the collating and binding operation.

Also unsatisfactory has been the use of calipered thickness information to determine if a book of signatures should be rejected. Where the thickness can vary widely as occurs when various editions are run simultaneously, fixed tolerance limits results in the rejection of good books of signatures which calipered out of tolerance due to changes in atmospheric conditions or the like. This has resulted in rejection of unnecessary books, or in setting the tolerance limits for the caliper too wide and thus allowing some defective books to go undetected.

SUMMARY OF THE INVENTION

In accordance with the present invention, the disadvantages found in prior signature collating systems which can produce customized books of signatures during a single production run have been overcome. A noncontact printer is located within a collating line, between adjacent signature feeders, to custom print information on the signatures fed from upstream feeders. The downstream feeders then deliver signatures over the printed signature, and the books are then bound, so that one or more intermediate signatures in the bound books have custom printing. A second noncontact printer, located after the trimmer prints mailing labels under control of the mailing coded data. Both noncontact printers may be of the dot matrix type, such as ink jet, which print along one direction only. Movement of the collating conveyor provides the other direction needed to form characters by a matrix of dots.

Each printer is followed by an optical scanner which detects the absence of characters in any line where a character should have been printed. The scanner automatically compensates for background variations in the surface against which the characters are printed. Any errors result in rejection of the book of signatures.

A replacement book feeder contains standard books of signatures which are selectively fed into empty conveyor spaces resulting from the rejection of defective books. When the standard books in the hopper fall below a predetermined level, new standard books are automatically reordered and are automatically diverted off the conveyor and into the hopper. When a book is rejected, the computer determines whether it should be reordered immediately, or should be replaced by a standard book.

A master caliper detects the thickness of each book of signatures leaving the signature feeders for comparison with a calculated thickness based on the various combinations of signatures which should have been fed to form the book. Variations in atmospheric conditions, such as temperature and humidity and ink changes, are detected by automatically calipering various combinations of signatures, calculating an air factor for the interfaces between signatures, and sampling signature variations to create a floating factor which follows changes in atmospheric conditions. The air factor, floating factor, and other calculations are used to compensate the readings from the caliper, so as to more accurately detect whether a book has the proper signatures.

One object of the present invention is the provision of a signature collating system having selectively controllable printing of intermediate signatures in a book of signatures.

Another object of this invention is the provision of a collating conveyor having a noncontact printer, which may be a dot matrix printer which prints along a transverse direction, with movement of the collating conveyor providing the other direction needed to form a matrix of dots. The resulting characters are detected by an optical scanner which determines errors in a printed line.

A further object of this invention is the provision of an improved signature collating system in which desired signatures can be custom ordered and then automatically diverted from the conveyor into a hopper of a selectively controlled feeder which feeds the signatures back onto the conveyor. The diverted signatures can form standard books of replacement signatures which replace rejected books of signatures. When a book is rejected, it is replaced by the standard book or is automatically reordered in accordance with the coded information which controlled the feeder actuation.

Still a further object of this invention is the provision of a collating line having a master caliper for detecting variable signature thicknesses resulting from selectively actuated feeders. These thicknesses are then compensated for variations caused by atmospheric conditions, ink changes and the like.

Other objects and features of the invention will be apparent from the following description and from the drawings. While an illustrative embodiment of the invention is shown in the drawings and will be described in detail herein, the invention is susceptible of embodiment in many different forms and it should be understood that the present disclosure is to be considered as an exemplification of the principles of the invention and is not intended to limit the invention to the embodiment illustrated.

BRIEF DESCRIPTION OF THE DRAWINGS

FIG. 9 is a schematic diagram of interface A, interface B and interface C shown in FIG. 8;

FIG. 16 is a logic flow chart of the scanner task of the control program;

FIG. 17 is a logic flow chart of the make-ready mode 01 module of the control program;

GENERAL OPERATION

Figure 1:
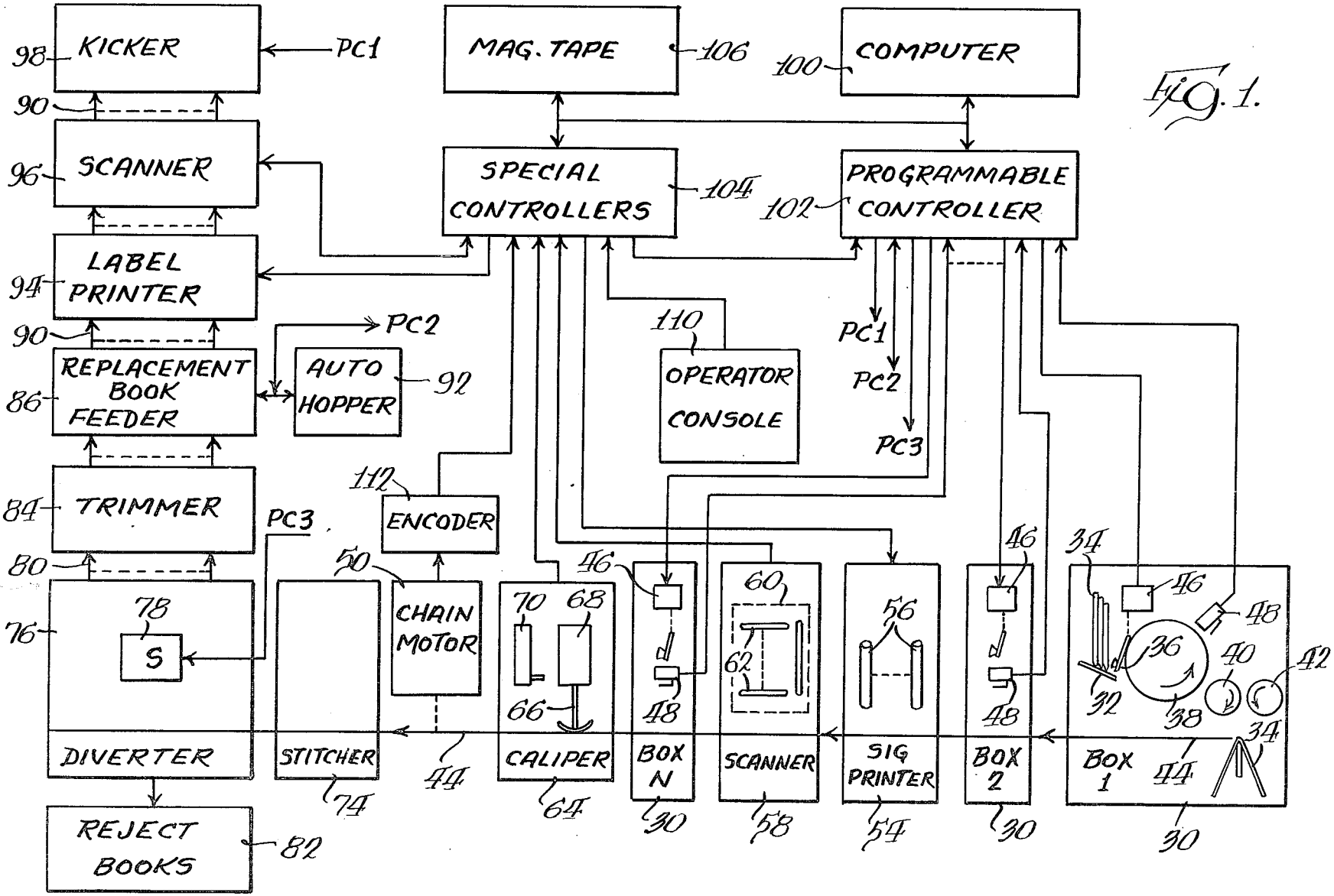
FIG. 1 is a block diagram of a signature collating and binding system and associated control therefor.

FIG. 1, a collating and binding system is illustrated for a saddle binder or stitcher line. Such a system includes a large number N of signature feeders or inserters 30. For clarity, only three feeders are illustrated, labeled Box 1, Box 2 and Box N. Each feeder 30 has a magazine 32 for storing a plurality of signatures 34, each signature being composed of one or more sheets. Individual signatures are seized by a vacuum sucker 36 and are conveyed by a primary cylinder 38 to a transfer drum 40 and an opener drum 42 onto a collating conveyor chain 44. When a vacuum pressure control 46 is actuated, the next signature 34 is transported in the cylinder 38, and it contacts a detector switch 48 which, in the case of a saddle binder line, may comprise a missing signature switch which produces an error signal when the feeder has failed to deliver a signature. For other types of collating and binding lines, switch 48 may take other forms, such as a double signature detector actuated when two signatures are fed in response to one feeder actuation. The above described feeder station is conventional and may take the detailed form shown in Abram et al. U.S. Pat. No. 3,899,165 or may take other forms.

The conveyor chain 44 is driven by a chain motor 50 in order to convey each conveyor station adjacent each of the feeders 30. It should be understood that several separate chains and associated chain motors may be provided throughout the entire system, and operated in synchronism so as to effectively form a continuous collating conveyor.

Intermediate a pair of the signature feeders 30 is a signature printer, designated sig printer 54, which has a plurality of printer heads 56, one for each line to be printed. After an upstream signature feeder 30 has fed a signature, the signature is conveyed adjacent the printer heads 56 which are controlled to print a matrix of dots, each matrix forming a character, directly on the uppermost or exposed signature. Each printer head 56 prints a different line as the signature is moved past the head by the collating chain 44. The signature then passes an optical scanner 58 having a scanning head 60 with a separate optical detector 62 for each line and hence for each printer head 56. If any detector 62 does not detect a character in a line when a character should have been printed by the corresponding printer head 56, an error signal is generated to indicate a defective book.

The signature with custom printing, after passing the scanner 58, travels past downstream feeder stations 30 which cover the printed signature with new signatures stored in the magazines of those stations. As the conveyor chain 44 continues, signatures are selectively delivered in order to progressively build books of signatures which have individual variations due to the action of the sig printer 54. Additional sig printers 54 and scanner 58 may be intersperced throughout the feeder-line, as desired, to custom print information throughout a book (i.e. group) of signatures.

After leaving the line of feeders 30, the conveyor stations are driven past a master book caliper 64 which includes a caliper probe 66 of a sensor 68 which generates an analog signal directly proportional to the actual thickness of the adjacent book of unbound signatures. A cycle control switch 70 produces an output signal when the probe 66 is contacting that portion of the book which will provide valid thickness information. Switch 70 enables the analog signal from the sensor 68 to be passed to the control system for use in determining whether the measured thickness corresponds with a calculated thickness based on the number of signatures which were to have been fed by the signature feeders 30.

After passing the caliper station 64, each book of signatures reaches a stitcher 74 which may include one or more conventional stapler mechanisms for securing together the book of signatures. The stitched or stapled book of signatures is conveyed to a diverter 76 which, in response to actuation of a solenoid (S) 78, diverts the book either onto a trimmer in-feed chain 80 operated in synchronism with the signature chain 44, or onto a reject books station 82. The books not rejected are trimmed by a conventional trimmer 84 and then conveyed past a replacement book feeder 86.

Various chains 90 operated in synchronism with the trimmer in-feed chain 80 continue to convey the books of signatures past the replacement books feeder 86 and towards the output station. The replacement book feeder 86 includes an auto hopper 92 which stores a plurality of standard books of signatures which can be substituted for a custom book of signatures in case the custom book is rejected. The auto hopper 92 is automatically replenished from the collating conveyor itself, as will appear, so as to store at all times a sufficient number of replacement books. If a conveyor station is empty because a book has been rejected, and that book has not been reordered by the control system, as will be described, the replacement book feeder 86 is actuated to deliver a standard replacement book of signatures from hopper 92 to the collating chains 90.

The books of signatures are then conveyed to a label printer 94, which is generally similar to the sig printer 54 in that it contains a plurality of similar printer heads 56. Each printer head prints a single line of the label. The lines of characters may be printed directly in a label area on the upper signature, or on a blank label which can be applied by a blank label applicator located immediately upstream of the label printer 94. The printed mailing label then passes a scanner station 96 which is similar to scanner 58, and contains a scanning head 60 with a plurality of detectors 62 corresponding to the number of printing heads 56 in the label printer 94. The labeled books of signatures then pass a kicker 98 which is actuated to displace books of signatures when special handling is desired.

Downstream of the kicker 98 may be various output processing devices such as a town sorter, a stacker, and other signature handling devices. The collating line may include additional processing or handling devices of a standard nature, not illustrated, such as a thin book reject station in advance of the diverter 76, a long book or hanging book detector, a loose card inserter, and other devices depending on the nature of the operations being performed.

The control system for the collating and binding system includes, in part, a computer 100 and a programmable controller 102 which contain the control programs to be described. A number of special controllers 104, in conjunction with the programmable controller 102, provide the interface between the devices on the collating line and the remainder of the control system. Control information as to the signatures to be delivered for each particular subscriber is supplied by coded information contained on a magnetic tape read by a mag tape reader 106. Each subscriber is identified by name, address, city, state, zip code and a special identification or I.D. which indicates the particular signatures which are to be contained in the book of signatures delivered to that subscriber. An operator console 110 allows an operator to manually enter the correlation between the special I.D. and the particular feeders 30 which are to be actuated each time that code is present. The Special I.D. code generally provides various demographic information, coded in an arbitrary manner generally selected by the publisher. Thus, the operator console 110 allows entry of any publisher's code into the system.

Information as to the location of all conveyor stations is provided by an encoder 112 which is driven by the chain motor 50. Each time the encoder 112 generates a new coded signal, the computer 100 receives an interrupt which is serviced to cause both input and output signals to be generated to all devices along the collating line which need servicing at that time. The computer 100 is informed at all times of the location of each signature station throughout the collating system, and controls all operations associated with each collating station as it progressively travels from Box 1 to and beyond the kicker 98.

CONTROL SYSTEM

For clarity, FIG. 1 illustrates only certain components of the control system. The entire control system is illustrated in block form in FIG. 8, and will now be generally described. Computer 100 may be a minicomputer such as a PDP-11 of Digital Equipment Corporation, and includes several printed circuit boards containing a CPU 120, a memory 122 (and an external mass storage as is desired), and a clock 124, which are tied to a universal bus or Unibus 126. For operator communications in addition to operator console 110, a teletype TTY 128 and a CRT communications device 130 are also connected to the Unibus 126. A reader/punch 132 provides an additional input/output terminal.

The controllable devices and the sensors in the collating system are coupled to the Unibus 126 through special controllers 104, which consist of a number of individual controllers as illustrated, the programmable controller 102, and a number of interface boards 134. The interfaces 134 may be standard I/O interface communication boards provided by the manufacturer of the computer 100, and three special interfaces, labeled interface A, interface B and interface C, the details of which are illustrated in FIG. 9 and will be described later.

Figure 8:
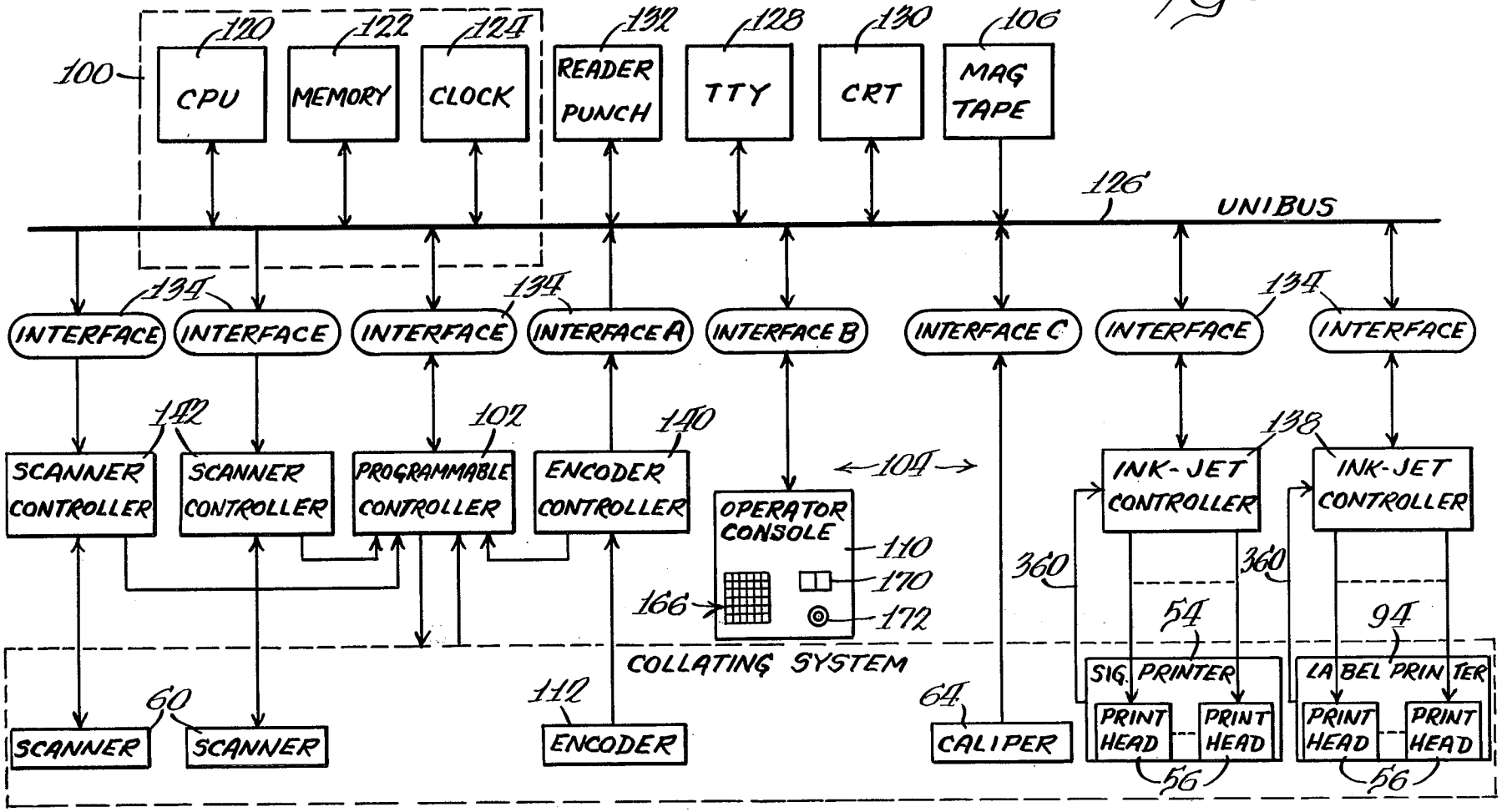
FIG. 8 is a block diagram of the control system, portions of which are shown in FIG. 1.

The single lines shown in FIG. 8 represent logically the flow of control information and data, and may be comprised of one or more individual wires.

The sig printer 54 and the label printer 94 have identical noncontact print heads 56 of the ink-jet type. The ink-jet print heads 56 are controlled by conventional types of ink-jet controllers 138 which connect via the standard interface 134 to the Unibus 126.

The encoder 112 which is driven by the chain motor of the collating conveyor is coupled to a conventional type of encoder controller 140 which is coupled by interface A to Unibus 126 and by a plurality of lines to the programmable controller 102.

Figure 5:
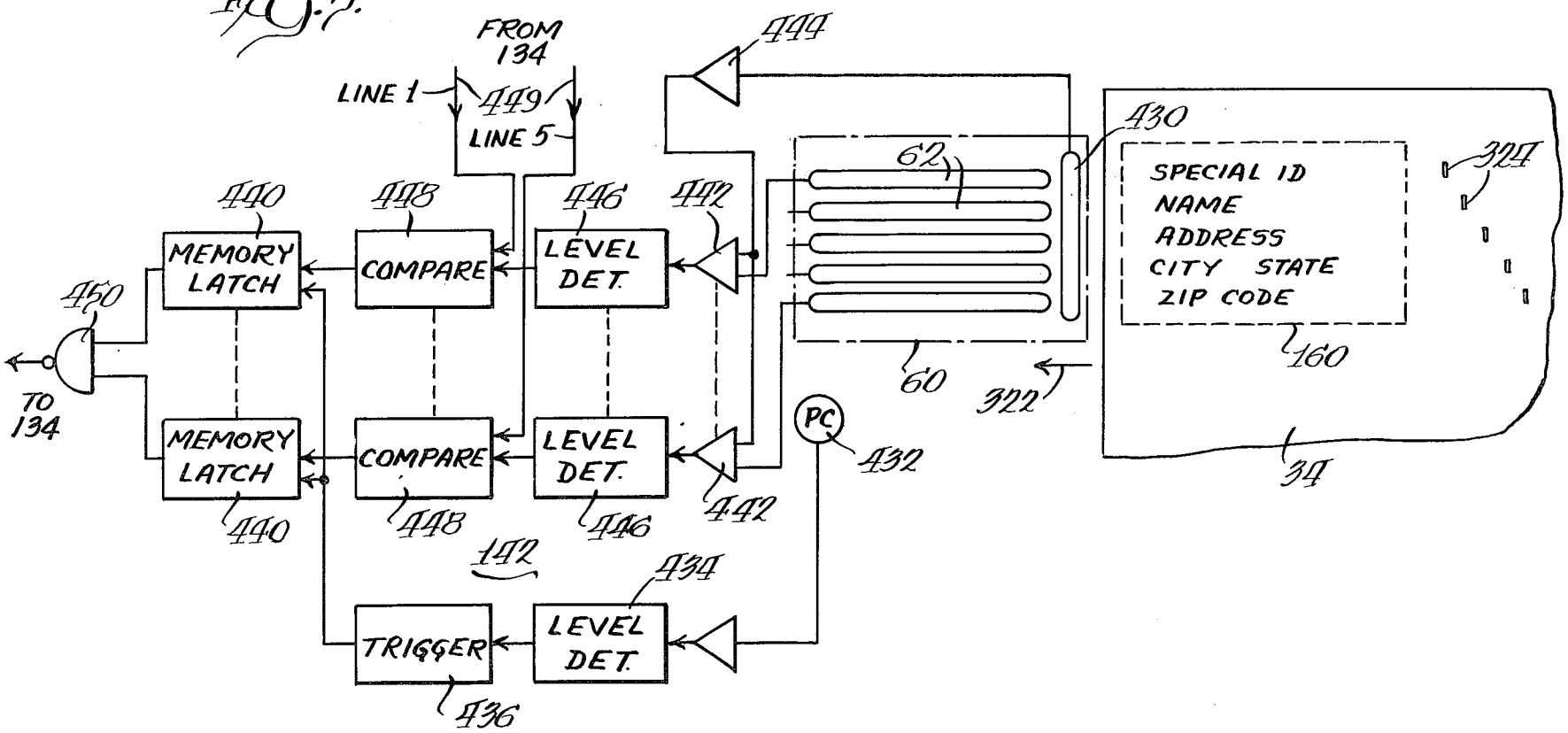
FIG. 5 is a block diagram of a scanner head and associated circuitry for the scanner shown in FIG. 1.

The optical scanners 60 which are immediately downstream of the sig printer 54 and the label printer 94 are each coupled to a scanner controller 142, the details of which are illustrated in FIG. 5. The outputs of the scanner controllers 142 are coupled through standard interfaces 134 to the Unibus 126.

Programmable controller 102 may be an Industrial 14/30 or 14/35 manufactured by the Digital Equipment Corporation. It includes a main memory containing program storage and internal function storage, a port connected by interface 134 to the Unibus 126 for communications with the computer, and a large number of inputs and outputs coupled with the collating system, the scanner controllers 142, and the encoder controller 140. Some of the input and output connections with the collating system are shown in more detail in FIG. 1, and include an output of each of vacuum control 46 and an input from each detector switch 48 of each signature feeder. Other inputs and outputs are coupled to other processing devices such as the diverter 76, the replacement book feeder 86, and the kicker 98. In addition, other devices such as the stitcher 74 may be controlled by the controller 102 for operation in synchronism with movement of the collating line. Various indicators may also be located along the collating line for energization by the programmable controller. The controller 102 may be programmed by use of a boolean control equations for actuating a device which a number of conditions are present or absent, which conditions will be described later.

Computer 100 of FIG. 8 stores a number of standard programs for executive, supervisory, utility, I/O and other standard functions and tasks, and in addition, stores a control program, as illustrated in FIGS. 12–22, for controlling the collating system. The detailed operation of the individual program modules and tasks will be described in this section and in the sections corresponding to the collating devices being controlled thereby. For clarity, only certain of the logical flow paths will be described in detail, the other alternatives and possibilities in the logical flow paths being apparent by following the various possible branches through the flow charts.

Figures 10, 11:
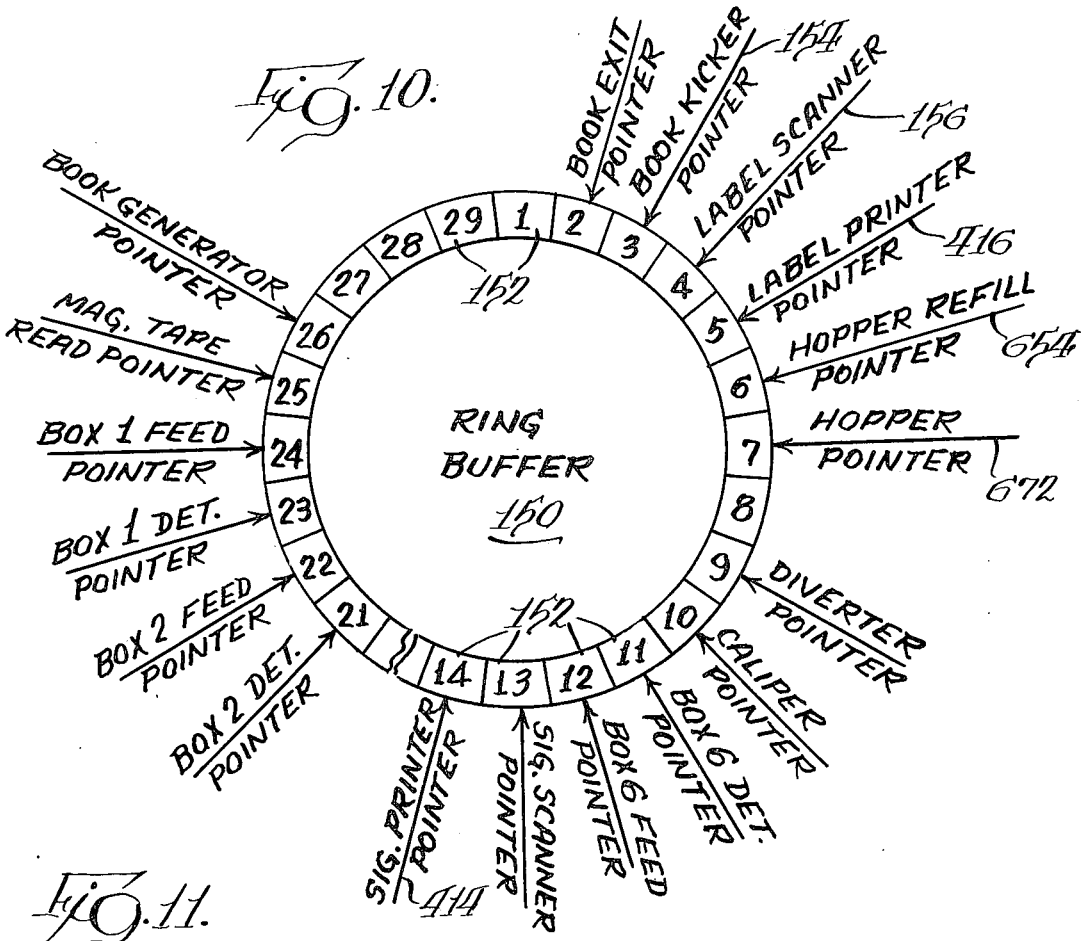
FIG. 10 is a diagramatic representation of the ring buffer which is formed in the memory shown in FIG. 8.
FIG. 11 is a chart illustrating the ring buffer book format for each of the twenty-nine books illustratively shown in the ring buffer of FIG. 10.

Memory 122, which may be supplemented by external mass storage, stores a ring buffer 150 which is diagramatically illustrated in FIG. 10. Each collating station at which an operation can be performed (or alternatively stated, each book being made) has a separate memory area 152 of fixed length reserved therefrom. For simplification in order to better describe the principles involved, it is assumed that entire length of the collating system is represented by 29 collating stations, extending from in advance of the box 1 feeder, labeled station 29, to one station, labeled 1, located after an output processing device which follows the kicker 98. This accommodates, as seen in FIG. 10, six signature feeders 30. In practice, the number of signature feeders would be greatly in excess of this number, and the ring buffer would be correspondingly larger in size.

The collating stations 152 are numbered sequentially, and as shown in FIG. 10, the first collating station 1 has traveled through the entire collating system and has just exited. The next collating station 2 is ready to exit, and the following collating station 3 is now adjacent the book kicker 98. The contents of the memory areas are effectively shifted counterclockwise with movement of the collating conveyor (in practice, the contents may be at fixed memory addresses and registers indicate where along the ring buffer the addresses are effectively located). A book kicker pointer 154 represents a register which receives the address of the memory location 152 located adjacent thereto so as to allow the book kicker to be operated in accordance with the contents of that memory address. Similarly, the next collating station is adjacent a label scanner pointer 156 for the scanner 96 in FIG. 1. Not every memory area 152 represents a collating station at which an operation occurs.

Each memory area 152 stores 168 words, each word being composed of 16 bits. The format of the words stored in the memory locations 152 is illustrated in FIG. 11. The first 16 bits, representing word 1, are reserved for coded information concerning the book mode, described later. The next 16 bits, word 2, are reserved for a book sequence number, which represents the current running total of the number of books of signatures constructed since the start of a production run.

The 16 bits in word 3 respectively represent the first 16 box feeders 30, and the 16 bits in word 4 respectively represent the box feeders 17 through N. Additional words (not illustrated) are provided if the number of box feeders exceeds 32. Each bit, corresponding to one particular box feeder, is set when the box is to feed its signature. Word 5 is reserved for the expected book thickness, which comprises a running total of the signature thickness at the collating station as each box feeds. After reaching the caliper 64, the total stored in word 5 is then compared, with certain compensations for signature thickness variations due to atmospheric conditions and the like, with word 6 which receives the actual caliper thickness.

Word 7 contains individual bits which are set if certain errors occur during the collating operation. For example, if a signature should fail to feed, the associated detector 48 will generate a signal which results in placing an error bit in bit position 1 of word 7. As the collating station represented by words 1–168 travels past downstream feeders, the control program recognizes the error bit and prevents signatures from feeding, even though the bits in words 3 and 4 indicate that a signature is to be fed. The resulting downstream shut-off of the signatures saves resorting of signatures which would otherwise be necessary when this book is rejected by the diverter 76.

Words 8–168 contain the alphanumeric characters for the mailing label 160, FIG. 5. The mailing label 160 may be an actual lable on the uppermost signature, or may be a reserved area on the uppermost signature. The Special I.D., word 8, typically comprises a combination of alphanumeric characters selected by a publisher to represent demographic information about the subscriber whose particular identity follows in words 9–68. The demographic information may indicate particular interests of the subscriber or other information, which results in his receiving a different combination of signatures than other subscribers whose magazines are being collated during the same production run. A particular series of arbitrary codes, for example, may indicate that the subscriber is to receive certain advertising signatures or special editorial signatures not received by other subscribers. Since each publisher arbitrarily selects the symbols representing Special I.D., the meanings assigned thereto must be entered into the computer before a production run begins.

Entry of the Special I.D. code with respect to each feeder which should be actuated for that code is manually made on a matrix of switches 166 on the operator console 110. As is partly illustrated in FIG. 9, the matrix 166 consists of 10 vertical columns of wires, and as many horizontal rows of wires as there are feeders 30, each row corresponding to a different feeder. The matrix of wires are insulated from each other, and at each cross-over location, there is a switch (not illustrated) which interconnects the wires when closed. The first 8 columns represent the Special I.D., in the form of an alphanumeric character in ASCII code. The ninth column is a "constant", which is set for every feeder which is to feed irrespective of the Special I.D. code. The tenth column is used to select the signatures which will make up the standard replacement book stored in the auto hopper 92.

By way of example, it will be assumed that the Special I.D. character "A", when present, indicates that signatures placed in the first and last feeders should be fed to the collating stations carrying an "A" in word 8. The operator closes those switches in the first row, which correspond to 1 bit in the character "A" when represented in 8 bit ASCII code (01000001), i.e. closes the switches in the second and eighth columns, closes the same switches in the last row. If the second, third and fourth feeders were to feed for all books being made in that production run, the switches in the ninth column would be closed at rows 2, 3 and 4. If the standard replacement book was to be composed of the same signatures, the switches in the tenth column would similarly be closed at rows 2, 3 and 4.

After the operator has entered the correlation between the special I.D. code and the signature feeders which are to be actuated thereby, thumb wheel switches 170 are moved to a desired mode, and an enter switch 172 is actuated. The enter switch enables an interrupt control 174 in interface B, FIG. 9, to pass an interrupt message to the Unibus 126 when the computer has cycled to the address corresponding to interface B. When this address is placed over the Unibus 126, an address selector 176 decodes the same and passes the interrupt to the CPU 120. At the same time, the contents of a buffer 178, which stores the current position of the mode switch 170, is passed so that the CPU can determine if the matrix 166 is to be read at this time. If so, a separate address of an address selector 180 is transmitted over the Unibus in order to gate into a buffer 182 a decoding signal which is read by a column select and decode 184 to energize the particular columns which are to be read. The signals passed through the closed switches (not illustrated) of the matrix 166 are passed by isolaters 186 to buffer 188 for subsequent transmission to the CPU. While the Special I.D. code has been entered through the matrix 166, the same information could be entered through the TTY 128 or CRT 130 by listing each alphanumeric character in the Special I.D. code, and the feeders which are to be actuated when that character is present.

Figure 21:
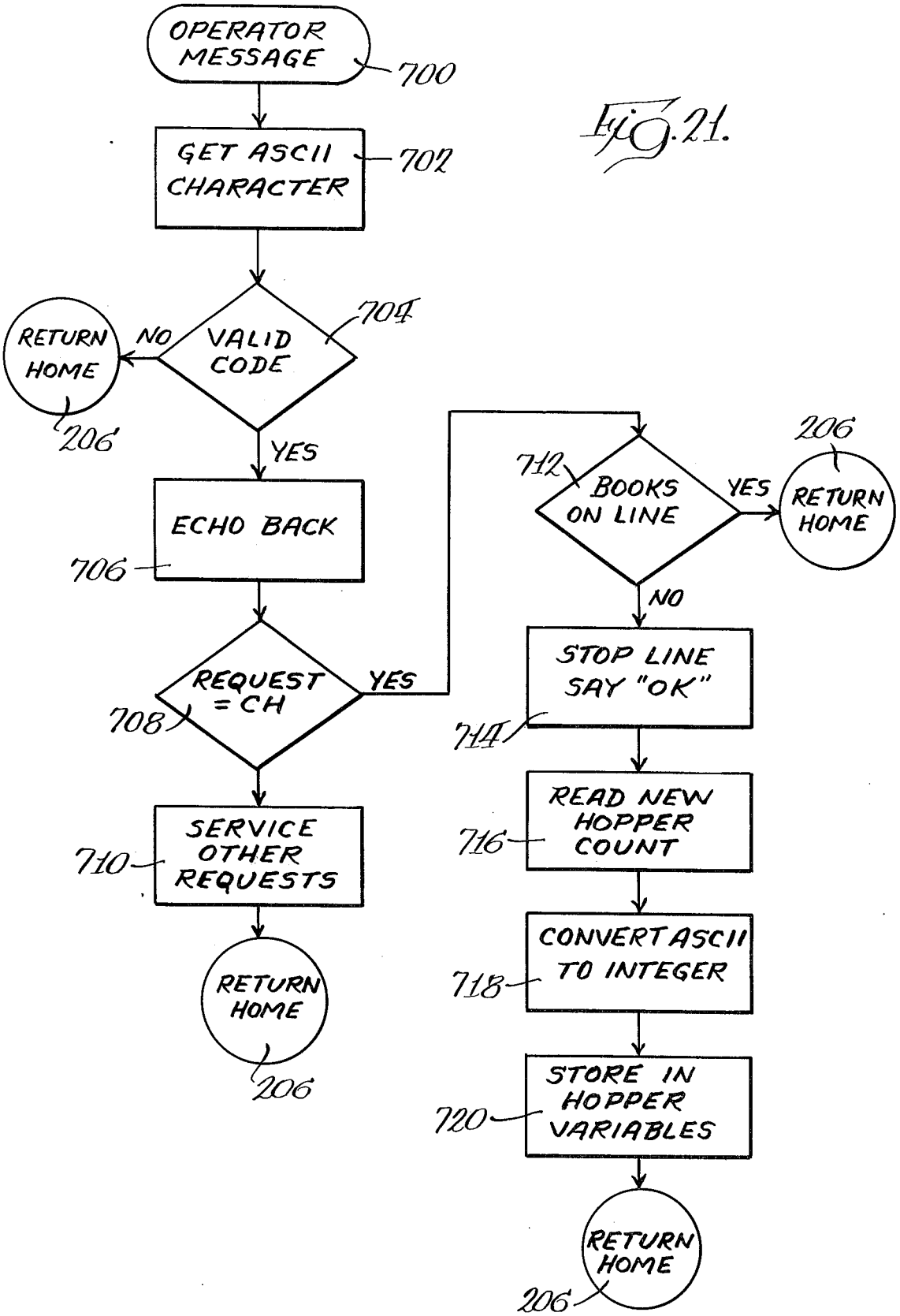
FIG. 21 is a logic flow chart of the operator message module of the control program.

Seven modes of operation can be selected on the mode thumb wheel switches 170, FIG. 9. In mode 00, the system is reset back to an initial state. Mode 01 is the make-ready or trial run, discussed with reference to FIG. 17. During mode 01, the operator through the TTY can generate operator messages, handled as shown in FIG. 21, to establish the number of standard books which are automatically reordered to fill hopper 92, and to define other operations such as the number and types of books defined as office copies and a quality copies.

Mode 02 generates standard books as defined by column 9 the matrix switches 166. The number of standard books can be selected on the TTY. When mode 02 is carried in word 1, FIG. 11, printing at the sig printer 54 and the label printer 94 is inhibited, and the outputs of the scanners 58 and 96 are ignored. The resulting books are used to fill order for newstands, and a certain number can be used to manually fill the hopper 92.

Mode 03 is the normal production run, which will be described in detail. Coded information is read from the mag tape or other computer input device, individualized books are made with custom printing on interior signatures, and after binding and trimming, the mailing label is printed directly on the book. The subscriber information on mag tap 106 can be searched to find a given subscriber, and operation can be resumed at that point. Mode 04 is used to clear the production run. The last book ordered is the last one on the assembly line. A run summary is then printed on the TTY giving error summaries, delay summaries, counts, and the like, based on a summation of the information in words 1–168 of all conveyor stations 152 which passed the book exit pointer of the ring buffer.

Mode 05 is essentially the same as mode 03 but only standard books are made regardless of the information carried in word 8, FIG. 11. Mode 07 disables automatic control and allows manual operation of the collating line for maintenance purposes.

Figure 12:
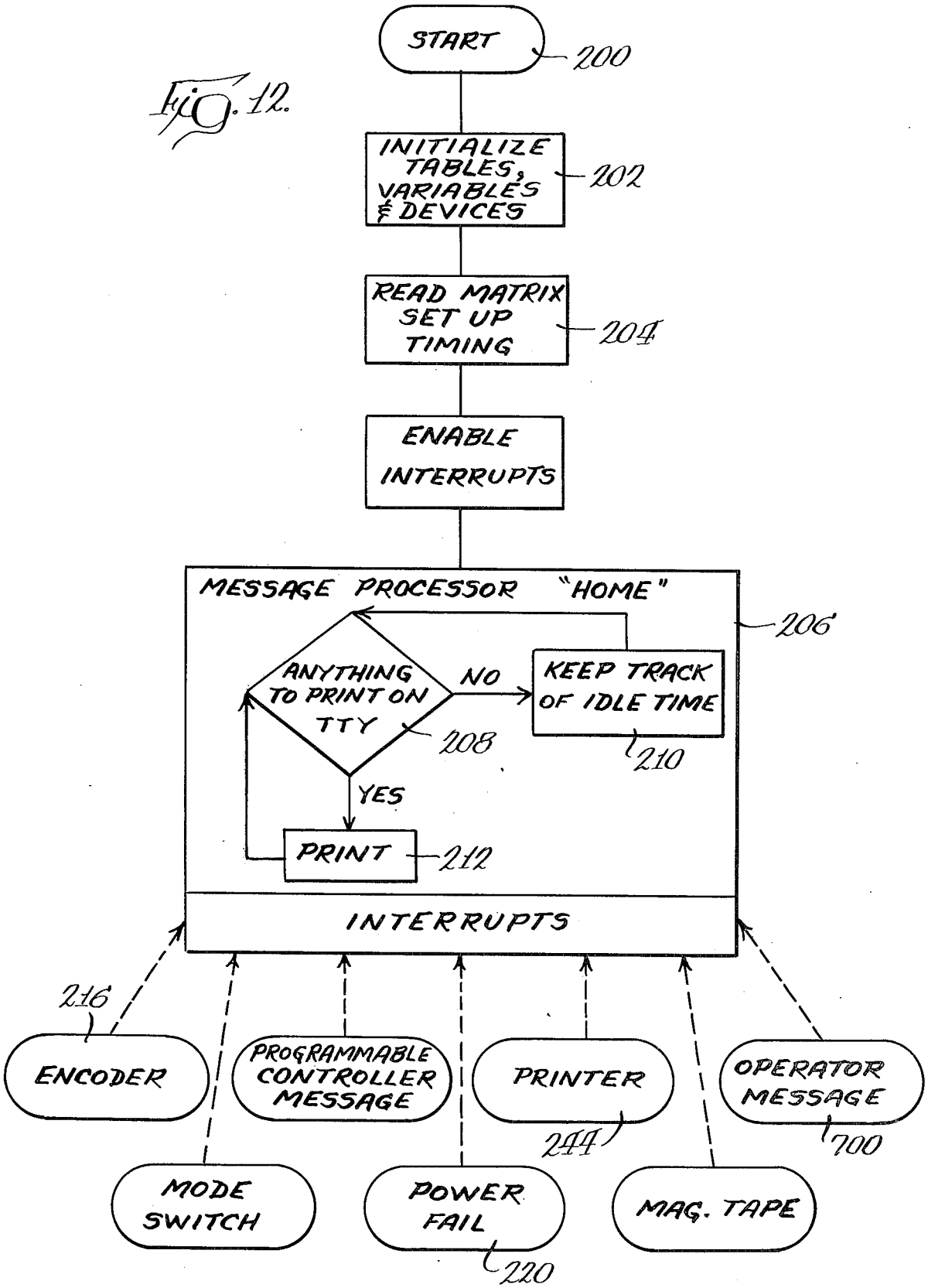
FIG. 12 is a logic flow chart of the start module of the control program executed by the CPU shown in FIG. 8.

The control program includes a start module, FIG. 12, which is entered at a start block 200 during initial start-up of the collating line, when the operator actuates the enter switch 172. Control passes to a block 202 which initializes the various tables, variables, and devices, after which a block 204 reads the matrix 166. Thereafter interrupts are enabled, and a message processor home routine 206 is entered which continuously processes any messages and interrupts. If there is nothing to print on the TTY 128, as determined by a decision block 208, a block 210 keeps track of the idle time and returns to the decision block 208. When a message is to be printed, a print block 212 controls the I/O communications with the TTY or CRT, after which control returns to decision block 208. If any interrupts occur, several of which are shown in FIG. 12, the start module passes control to the appropriate module or task which handles that interrupt. For example, a signal originating from the encoder 112 generates an encoder interrupt 216 which is serviced by a task module 218, FIG. 13. If a power fail interrupt 220 should occur, it is serviced by a standard executive program (not illustrated) for that type of interrupt.

Figure 13:
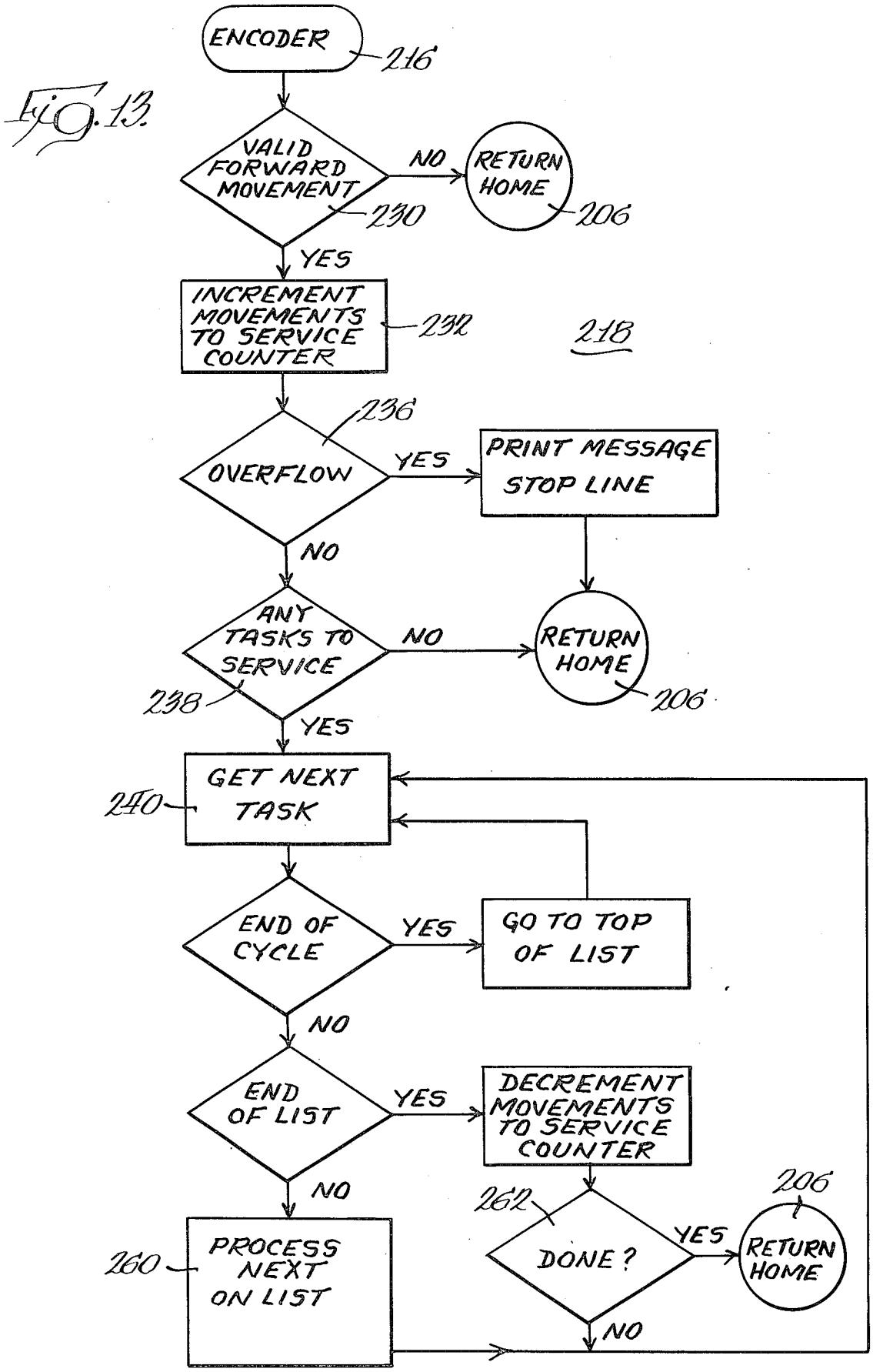
FIG. 13 is a logic flow chart of the encoder module of the control program.

Task handling module 218, FIG. 13, controls all the tasks which must be accomplished each time a collating line advances by an increment of movement which requires any action. Each cycle of rotation of encoder 112 is divided into four quadrants, each quadrant being capable of controlling different portions of a signature feeding operation, as is conventional. As the encoder 112 rotates by one quadrant, the encoder controller 140, FIG. 8, decodes the rotation and generates a unique signal, as illustrated in FIG. 9 indicative of the machine position. The signal is passed to a buffer 224 in interface A, and an interrupt control 226 passes an interrupt when the CPU has cycled to interface A as decoded by an address selector 228. The contents of the buffer 224 are then gated to the CPU, which posts an encoder interrupt 216.

Returning to FIG. 13, the encoder interrupt 216 is processed by a decision block 230 which determines whether there was valid forward movement. If not, a return to home routine 206 is made. Valid movement causes a block 232 to increment a quadrant service counter. After four such increments, collating station 4 as shown in FIG. 10, for example, will have moved adjacent the book kicker pointer 154. An overflow block 236, FIG. 13, determines whether all prior operations were completed for the last quadrature increment. A decision block 238 then determines what tasks are to be serviced at this time, as indicated by the pointers in FIG. 10. Typically, a large number of tasks must be serviced during any quadrant of movement from the encoder. The tasks are put in a line, assessed by a block 240 which passes control to the appropriate task. For example, each feeder has an associated box feed task 242, FIG. 14. Each printer is controlled by a printer task 244, FIG. 15, and each optical scanner is controlled by a scanner task 246, FIG. 16. The master caliper is controlled by a caliper task 250, FIG. 18, and the book kicker is controlled by a book kicker task 252, FIG. 22. After each task is completed, control returns to the task routine 218 which, if tasks are remaining causes a block 260 to process the next task on the list. When all tasks are complete, a decision block 262 causes the module to return to home routine 206.

During a production run, a list of subscribers is maintained on magnetic tape which is read by mag tape reader 106 each time a new book is about to be formed. As the encoder advances, a mag tape reader task is added to the task list, FIG. 13 of the task routine. As seen in FIG. 10, the ring buffer 150 has a mag tape read pointer which causes the next subscriber data on mag tape to be read and stored in words 8–168 of the adjacent memory area 152. The CPU now compares the bits in word 8 with the codes entered on the switch matrix 166, to determine which box feeders should be actuated. The codes that match cause individual bits to set in words 3 and 4, corresponding to the feeder boxes which should be actuated.

Figure 14:
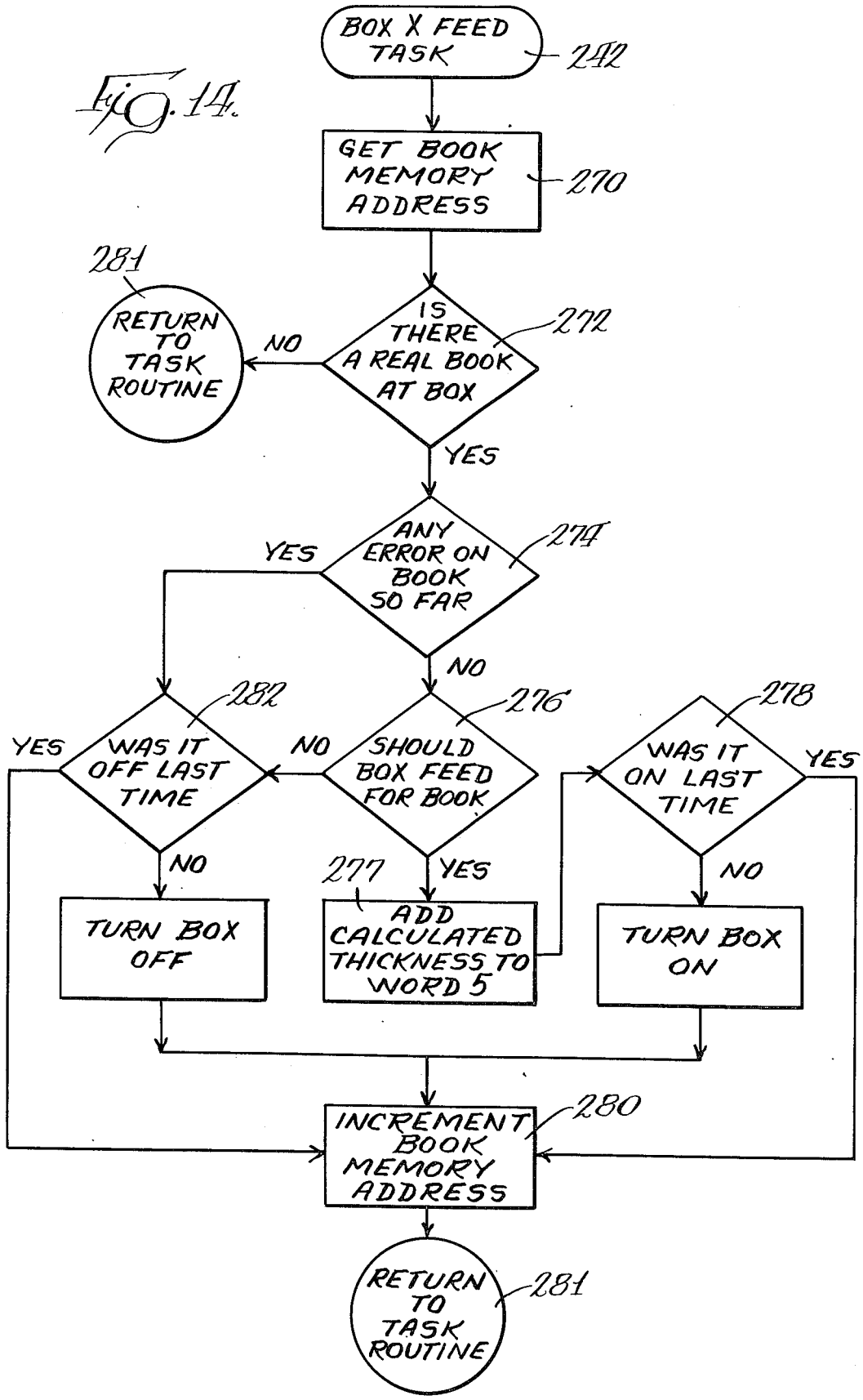
FIG. 14 is a logic flow chart of the box feed task of the control program.

A separate box feed task 242, FIG. 14, is provided for each feeder 30. When the task routine passes control to the box 1 feed task, for example, a block 270 will retrieve the memory address 152 for the book, i.e. the collating station, in the ring buffer 150 which is adjacent the box 1 feeder. For the example given in FIG. 10, book (or collating station) 24 is adjacent the box 1 feed pointer. A decision block 272, FIG. 14, looks at word 1, FIG. 11, stored at that address to determine whether a real book is being made at this time, as determined by the mode which was entered earlier under control of the book generator pointer.

If affirmative, control passes from block 272 to a decision block 274 which determines from word 7 whether any errors have occurred. If no errors have occurred so far, a decision block 276 looks at the first bit, for box feeder 1, in word 3. If it has been set, a signature is to be fed and control passes to a block 277 which takes the calculated thickness of that signature to be fed, as determined by the make-ready mode to be discussed later, and adds it to word 5 which maintains a running total of the calculated book thickness. Control then passes to a block 278 which determines whether the vacuum pressure control 46 was actuated the previous time, because control 46 remains on until turned off. The signature is fed, and control passes to a block 280 which increments the book memory address 151 to the next position 23 as shown in FIG. 10. After it is determined whether an error occurred, the ring buffer memory is incremented to area 22 and control transfers to the box feed task 242 for box 2.

If the bit in word 3 had indicated that box 1 was not to feed, control would have passed to a decision block 282 which would have insured that the vacuum control 46 was off. Returning to block 274, if an error had occurred as indicated by an error bit in word 7, control would pass to block 282 which would insure the vacuum control 46 was off, even though the first bit in word 3 indicates a signature should be fed. This downstream shut-off feature obviates unnecessary resorting of signatures back into the feeders after the book is rejected due to the error.

The operation of the remaining tasks will be described in the section most appropriate to the device controlled thereby.

SIG PRINTER AND LABEL PRINTER

Figure 2:
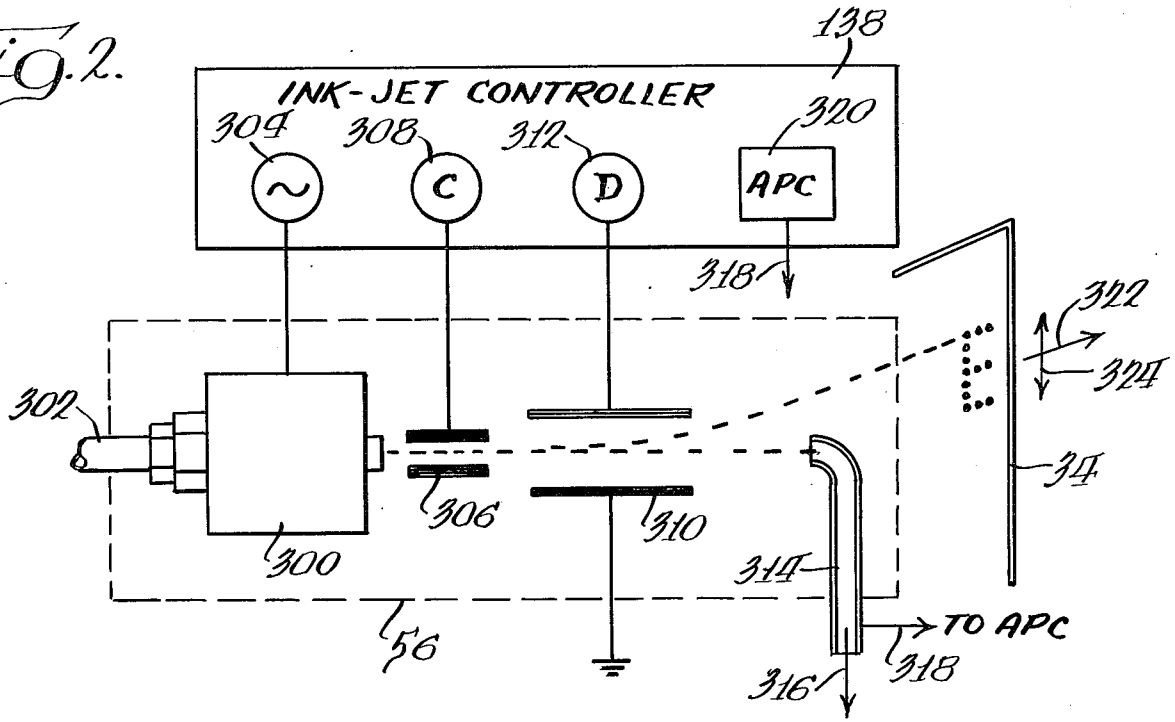
FIG. 2 is a diagramatic illustration of a dot matrix printer used in the sig printer and the label printer shown in FIG. 1.
Figure 3:
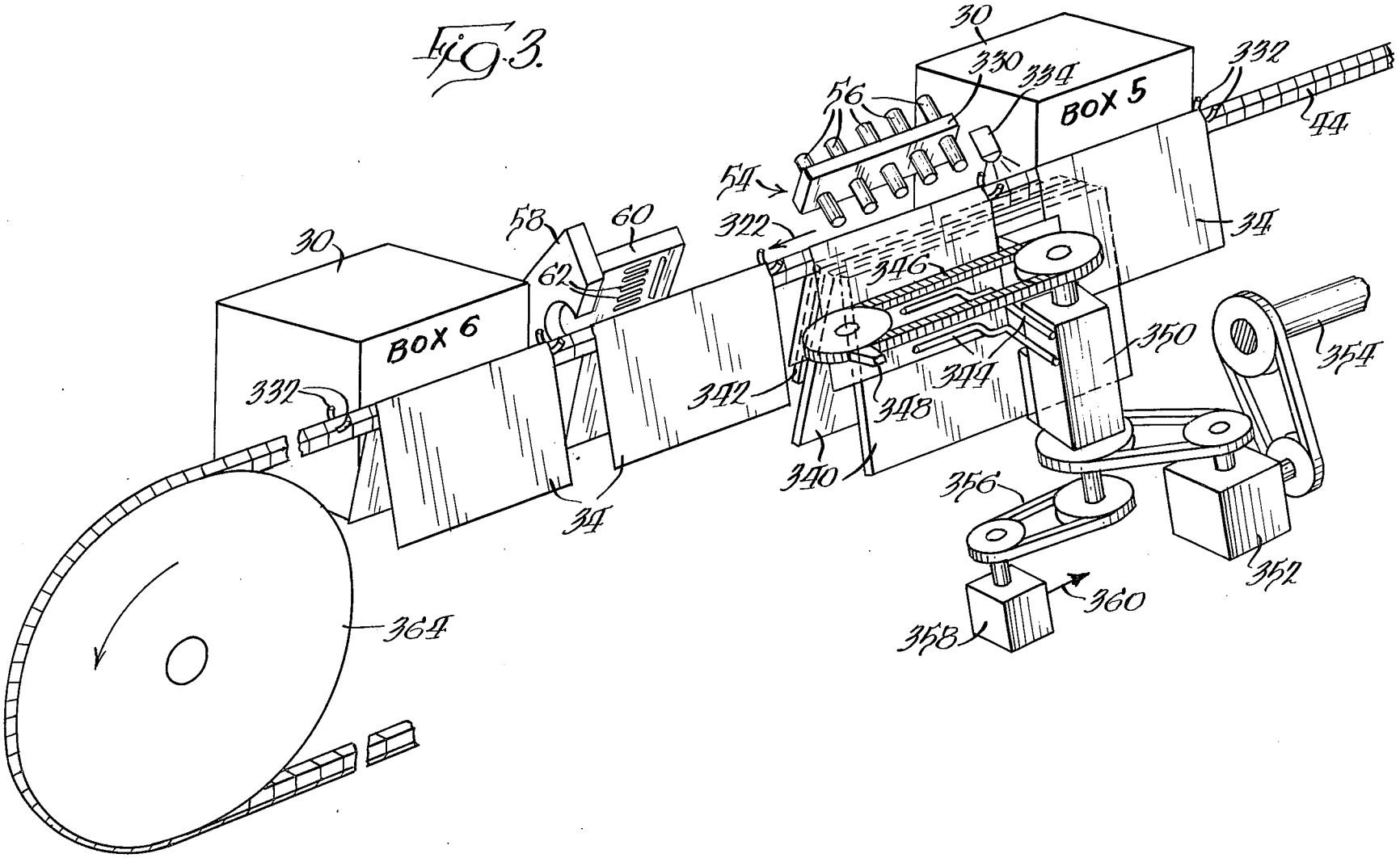
FIG. 3 is a perspective view of the sig printer, scanner, and adjacent portions of the signature feeder line shown in FIG. 1.
Figure 4A:
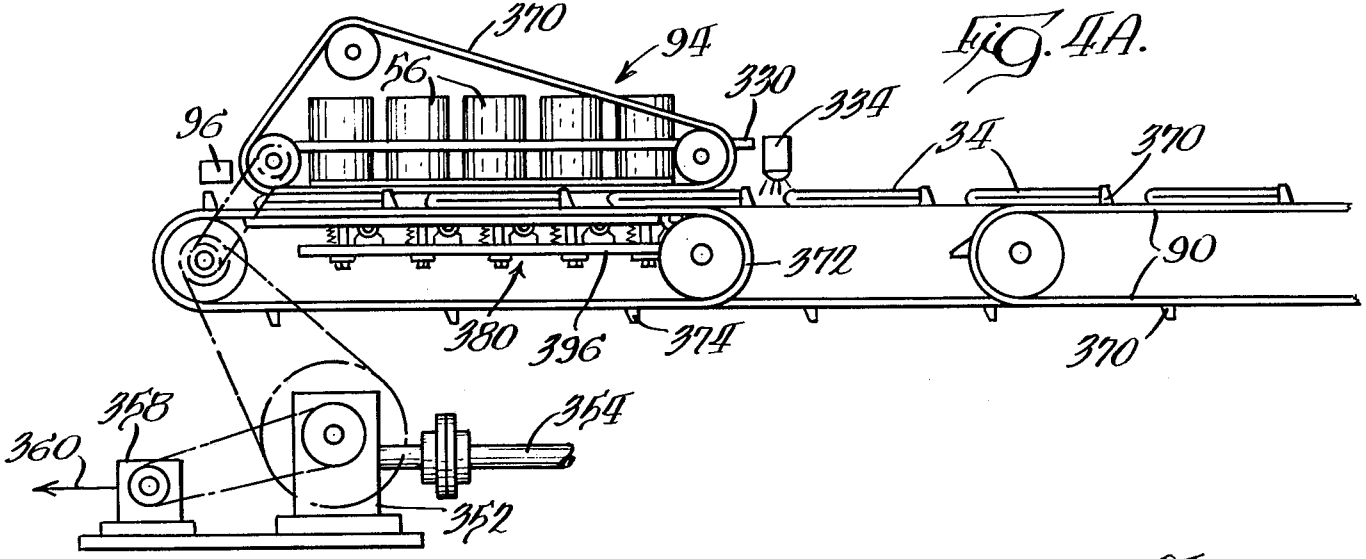
FIG. 4A is a side plan view of the label printer and scanner shown in FIG. 1.
Figure 4B:
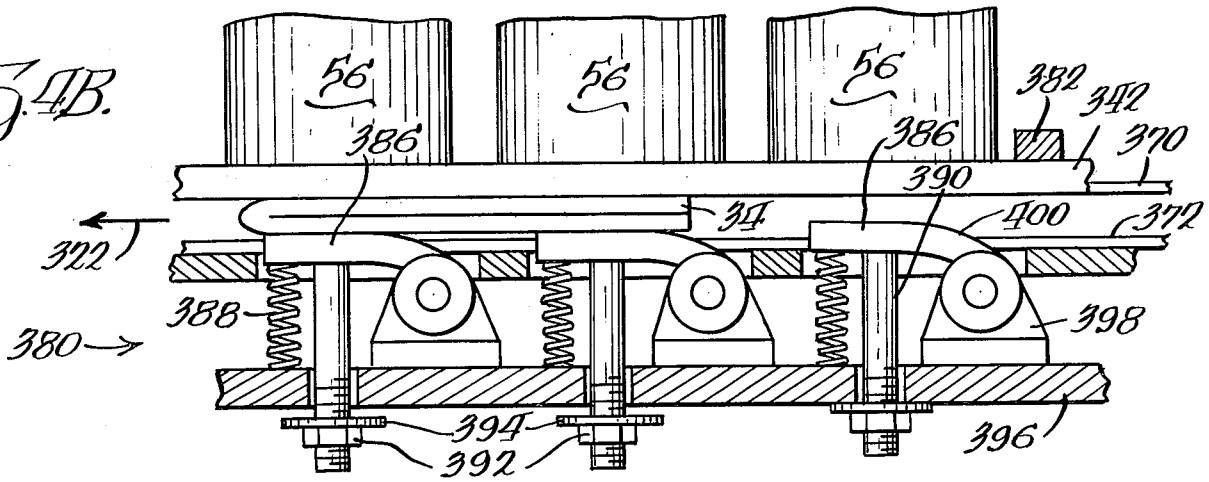
FIG. 4B is an enlarged side view, partly in section, of the signature thickness compensating mechanism for the label printer shown in FIG. 4A.

Sig printer 54, shown in detail in FIG. 3, and label printer 94, shown in detail in FIGS. 4A and 4B, both use identical print heads 56 for each line of alphanumeric or graphic characters which are to be printed. The print heads 56, FIG. 2, are desirably of the noncontact, dot matrix type. Each contains a nozzle 300 having an ink input line 302 from a pressurized ink source. The nozzle 300 is connected to an ultrasonic drive signal source 304 in the ink-jet controller 138. The droplets of ink from nozzle 300 pass a charging tunnel 306 connected to a charging signal source 308. The charged droplets then pass deflection plates 310 which are connected to a deflection signal source 312 which has a signal whenever a character is to be formed.

When no deflection signal is present at source 312, the droplets are captured by a sensor tube 314 and exit at an outlet 316 which leads to an ink return. The sensor tube 314 is coupled via a line 318 to an automatic phase control or APC 320. The ink-jet controller 138 has an input (see FIG. 8) from an encoder, as will appear, which detects the movement of an adjacent signature 34 along the longitudinal axis of the collating line, as represented by an arrow 322.

The deflection source 312 deflects the dots of ink along a direction 324 which is transverse to the direction of movement 322 of the signatures 34. Thus, the source 312, by itself, can only produce a line of dots along axis 324. In conjunction with the movement of the signature 34 along direction 322, however, a 5 × 7 matrix of dots is formed which prints any alphanumeric character, the character E being shown for illustration (not to scale).

The ink supplied to input line 302 may be a water based ink having a two to four second drying time, or a solvent based ink having a one-half second or less drying time. In the case of a water based ink, the collating line must allow 3 feet to 4 feet of travel for the signature 34 before another signature is fed thereover and before the character comes in contact with some member which could smear the ink. While an ink-jet printer has been illustrated, it will be appreciated that a contact printer having a plurality of actuable dot producing wires could also be utilized. By using the motion of the collating conveyor as an integral part of the printing process, the complexity of the printer can be greatly reduced.

The details of the sig printer 54, which uses five of the print heads 56 of FIG. 2, is illustrated in FIG. 3. A mounting plate 330 provides a 1/6 inch offset to each of the five print heads 56, to provide five lines of printing within a one inch width. Plate 330 is mounted by a support (not illustrated) to provide accurate positioning with respect to the foredge or backbone of the signatures 34. The collating chain 44 contains pusher pins 332 which define each collating station. As a group of signatures 34 are detected by a photo-electric sensor 334, a signal is sent via the programmable controller 102 to the computer 100 and calls up the printer task interrupt 244, FIG. 15, to be described later.

As the signatures pass the mounting plate 330, a pair of V-shaped guide plates 340 support the underside of the signatures. The upperside to be printed passes under a pressure plate 342 having a longitudinal slot throughout its entire length for the ink-jet. The pressure plate 342 is shown in more detail in FIG. 4B with respect to the label printer. On the opposite side, a pair of pressure guide rods 344 maintain the signatures flat so as to prevent a cock or flat-up.

An auxiliary chain 346 contains auxiliary pushers 348, one of which engages the signature in addition to the pusher pins 332. The auxiliary chain 346 is coupled through a drive train 350 and a gear box 352 to the rotating line shaft 354 for the collating line. The movement of the signatures is taken over by the auxiliary pusher 348 instead of the pusher pins 342, for any critical period of time while passing the printer heads 56, after which the signatures are released for engagement with the pusher pins 332 traveling slightly therebehind. Such an arrangement allows more precise control of the signature speed than does reliance on the collating chain 44. The auxiliary chain 346 as shown will control speed only during the end of travel of the signatures, where printing is illustratively occurring, but of course the chain can be extended to control speed during the entire time signatures are adjacent the print heads 56.

The drive train 350 also includes a gear belt 356 which drives an encoder 358 which generates encoder pulses over an output line 360 for coupling to the ink-jet controller 138. Each pulse represents the smallest increment between adjacent dots of the matrix of dots which can be formed. This in turn controls the generation of dots which are maintained in synchronism with the advance of the books, resulting in uniform character generation independent of speed variations.

After passing the last print head 56, the pusher pins 332 advance the signatures past the optical scanner 58 to be described later. The collating station then passes the next box feeder 30 at which another signature can be delivered under control of the box feed task 242, FIG. 14. The collating station continues to pass the remaining feeders in the collating line, and then the caliper 64 and other components shown in FIG. 1. The collating chain 44 engages a master drive sprocket 364 which is driven by the chain motor 50 in a conventional manner.

The book of signatures 34 can be in the form of two books joined in common for manufacturing purposes, but which are split into separate entities at the trimmer by a method commonly known as Five Knife Trimmers. The effective output of the ink-jet heads 56 is doubled by this method. At the point of separation, that is, the trimmer, each individual stream of signatures can contain suitable information for grouping of the separated books, such as by zip code designation.

Turning to FIGS. 4A and 4B, the label printer 94 is shown in detail. Elements having similar functions have been identified with the same reference number, although it will be understood that the size, shape and other details may vary in accordance with the different mechanical requirements. The mounting plate 330 mounts the individual print heads 56 vertically for printing on flat signatures, within a label area 160 as seen in FIG. 5. As the signatures enter the printer area by a pair of spaced chains 90 having pushers 370 thereon, they are driven between a pair of spaced upper pressure belts 370 and a pair of spaced lower pressure belts 372, which corresponds generally to the auxiliary belt 346 in FIG. 3. Lower pressure belt 372 carrys auxiliary pushers 374 thereon which engage the signatures in addition to the pushers 370.

Between the pair of lower pressure belts 372, a spring biased elevating mechanism 380, seen best in FIG. 4B, pushes the individual signatures up against the pressure plate 342. The pressure plate 342 consists of a pair of longitudinal bars which are spaced apart by cross-members 382, the gap between the longitudinal bars forming a continuous longitudinal slot through which the ink-jets from the print heads 56 are directed. The thicknesses of the books of signatures 34 will vary greatly, due to selective actuation of the feeders, but the elevator mechanism 380 maintains the top of the signature against the pressure plate 342 so as to provide an accuracte, consistant distance to the print heads 56.

The elevating mechanism 380, FIG. 4B, consists of an individual book carrier 386, such as a brass shoe, which is located directly under each print head 56 and is forced upward by a spring 388. The maximum vertical movement of spring 388 is restricted by the presence of an adjustment rod 390, the height of which is set by the position of an adjustment nut 392 threaded thereupon. A washer 394 spans the hole in a mounting plate 396 through which the adjusting rod 392 extends before fixedly engaging the carrier 386. The carrier 386 is pivotedly mounted to a base 398 fixed secure to the mounting plate 396. The leading edge surface 400 of the carrier is radiused to allow passage of any thickness of signatures onto the top of the shoe 386. The spring 388 then raises each individual book of signatures, or the portion thereof adjacent the print head 56, to a fixed established height with respect to the print head. The print station is fixed in height since the inertia of the carrier shoes 386 can be made considerably less than the inertia of the printing station. However, the printing station could be made adjustable with respect to an established fixed height of a lower support for the books of signatures.

Figure 15:
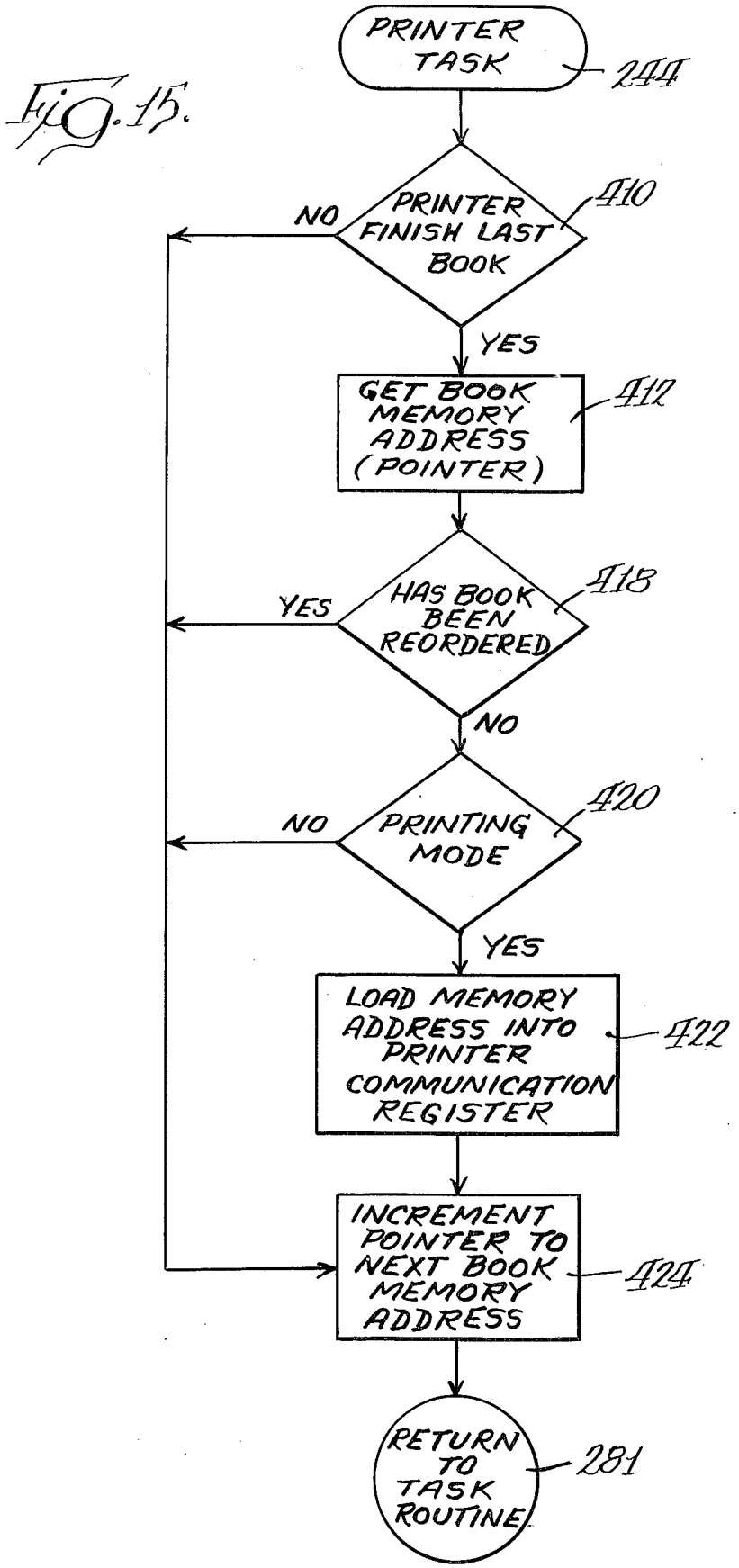
FIG. 15 is a logic flow chart of the printer task of the control program.

As the signatures pass the leading photoelectric detector 334, for either the sig printer 54 or the label printer 94, an interrupt is generated which, at the appropriate time of servicing the tasks, passes control to a printer task 244, FIG. 15. A decision block 410 determines whether the particular printer (sig or label) being serviced has finished the last book. If affirmative, a block 412 retrieves the memory area address in the ring buffer 150 of the collating station then adjacent the printer pointer. This is either the sig printer pointer 414 if the task concerns the sig printer 54, or the label printer pointer 416 if the task concerns the label printer 94. A decision block 418 then looks at bit 15 of word 7, see FIG. 11, to determine whether the book has been reordered. If not, a block 420 determines from word 1 whether the signature then present represents a real book which is to be printed. If affirmative, a block 422 loads the memory address of the book into the printer communication register, and transmits the contents of words 8–168 over the Unibus 126 to the ink-jet controller 138 associated with that printer. A block 424 then increments the pointer to the next book memory address.

While the information transmitted to the ink-jet controllers is typically the mailing information contained in words 8–168, FIG. 11, it will be appreciated that additional information may be stored for transmission to the printers. Particularly for the sig printer, the memory 122, FIG. 8, may store additional information of any type, such as information related to the demographic code carried in word 8. By chaining such additional information with the words 8–168, special custom printing directed to particular subscribers or classes of subscribers can be printed within interior signatures of the books of signatures.

OPTICAL SCANNERS FOR PRINTERS

Scanner 58 for the sig printer, and scanner 96 for the label printer, each include a scanning head 60 and an associated scanner controller 142, shown in detail in FIG. 5. Each line of possible printing, illustratively shown as five lines of printing, has an associated photoelectric detector 62 which produces an output proportional to reflected light along the entire line. To cover an entire line, a photocell may be located behind a longitudinal slot in the scanning head 60. An additional photoelectric detector 430 is oriented transverse to all lines of printing to determine the background level of the reflected light from the label or label area 160. A light source (not illustrated) provides constant illumination over the label 160 when under the scanning head 60. A photocell 432 detects when the signature 34 has reached a position where the entire printed area 160 is located under the head 60. The signal from photocell 432 is detected by a level detector 434 which generates a trigger signal 436 to open plural memory latches 440, one for each line of printed characters.

Each line detector 62 is coupled to a differential amplifier 442 which subtracts the background level, as detected by the photocell detector 430 and amplified by an amplifier 444, from the line level. The subtracted signals, representing the presence of one or more printed characters within the lines, are coupled to level detectors 446 which determine when the signal level has changed sufficiently to represent the presence of one or more characters. The output of detectors 446 are coupled to compare circuits 448, which have inputs 449 from interface 134, one input for each line of printing.

The scanner task routine, FIG. 16, which will be explained later, places a 1 bit on each line 449 for which one or more characters were supposed to have been printed. A comparison indicating that any line contains at least one character, when one character should have been printed, results in a specific bit output from the compare circuit 448 to the associated memory latch 440. At the time the memory latches 440 are triggered on, the compare circuit output represents valid information and is stored. The output of each memory latch 440 is coupled to an AND gate 450 which produces a specific bit output only when all memory latches have stored the specific bits representing a compare for all lines of printing.

If any compare circuit 448 should receive dissimilar inputs, meaning that one or more characters were not printed in a line which should have contained at least one character, or one or more characters were printed in a line which should have received no characters, then AND gate 450 is blocked and an error indication is produced. The CPU then posts a 1 bit in bit position 0 of word 7 if the lack of correspondence was from the scanner for the sig printer, or in bit position 2 of word 7 if the scanner was that associated with the label printer.

When each collating station reaches the scanner head 60, as indicated by the associated scanner pointer of the ring buffer 150, a scanner task is posted by the task processor 218. When the task is reached, the scanner task module 246, FIG. 16, is entered to generate the signals on lines 449. A block 460 determines the book memory address of the area 152 adjacent the associated scanner pointer. For simplification, it will be assumed that the information to be printed was that contained in words 8–168 of the memory location, and that this information results in five lines of printing, as shown in FIG. 5.

A block 462, FIG. 16, then sets the contents of line 1, which herein corresponds to the Special I.D., in a register with the first possible character location at the beginning of the register. A block 464 then clears a storage area of all "carry" bits, each carry bit indicating that one or more characters are contained in a line. A decision block 466 now determines whether the first character in line 1 is a blank (no character present). Assuming that the first character of the Special I.D. was a blank, a block 468 then increments to the next character location in the register, after which a decision block 470 determines whether the end of the line has been reached. Since only the first location was checked, control returns to block 466, which now determines whether the second character location in line 1 is a blank.

Assuming that a character is now present, a block 472 sets a carry bit for line 1, which in a block 474 is assembled into a scanner word which will be transmitted into the interface 134. The scanner word contains a bit location for each line of printing. A block 476 determines whether the end of the last line has been reached. Since only the first line was analyzed, a block 478 now clears the register and sets the contents of line 2 therein, with the first possible character location being located at the beginning of the register. Control now returns to decision block 466 and the operation is repeated for line 2.

After analyzing the last line, the scanner word contains 0 or 1 bits representing no characters in a line, or one or more characters in a line. Block 476 then passes control to a block 480 which sends the scanner word to interface 134 for the associated scanner controller 142, resulting in enabling as is appropriate of lines 449 in FIG. 5. A block 482 then increments the scanner pointer to the next book memory address.

CALIPER COMPENSATION

The book caliper 64 is connected through interface C, FIG. 9, to the Unibus 126. When the caliper task is serviced, as will be explained, the CPU places the address of the caliper over the Unibus 126. An address selector 500, FIG. 9, decodes the address and forms one actuating input to a driver 502. A proximity switch 70 determines when a book of signatures is properly located underneath the caliper probe 68. When proximity switch 70 is also actuated, the driver 502 gates open a sample and hold circuit 504 which stores the analog signal from the caliper probe 68. When the address of an analog-to-digital (A/D) convertor 506 is placed on the Unibus 126, the output digital thickness signal is passed to the computer.

The caliper 64 may take the form disclosed in U.S. Pat. No. 3,899,165, assigned to the present assignee, or other forms which provide an analog signal directly proportional to the thickness of the book of signatures then passing between the probe and a reference base. For the same number and type of signatures, however, the thickness signal will vary due to changes in atmospheric conditions, such as temperature and humidity, and gradual ink changes. Also, the entrapped air between signatures will cause the total thickness signal to be greater than the sum of the individual signature thicknesses.

During a make-ready mode, also known as a trial run, the box feeders 30 are selectively actuated and the resulting outputs are calipered to build a data base. Unlike prior trial runs, the data base is then analyzed to generate special compensation information which corrects later caliper readings. The operator enters 01 on the mode switch 170, FIG. 9, and actuates the enter switch 172.

The resulting interrupt causes the control program to enter a make-ready mode 01 module 510, FIG. 17. A block 512 makes three null books, that is, books without any signatures, by entering the 01 code in word 1, FIG. 11, and not entering any bits in words 3 and 4. When the resulting empty stations pass the caliper, a base reading is obtained which will be subtracted from subsequent readings. A block 514 then makes three books of one signature from each box feeder 30 in use. For example, box 1 will first be actuated three times, without any subsequent signatures being delivered to the collating stations carrying those signatures, followed by three actuations of box feeder 2, and so forth. Three actuations are utilized because it is desired to obtain an average thickness for the signatures, and single signatures have a tendency to blow off the collating chain. Thus, the number selected is that reasonably necessary to obtain at least two signatures in order to obtain an average.

Next a block 516 makes three standard replacement books, which are the books stored in the auto hopper 92. The box feeders which are actuated for replacement books are those originally entered into column 10 of the matrix switches 166. As these standard books pass the caliper, the reading is stored. A block 518 then makes three books containing signatures from all box feeders in use, and stores the calipered results. A block 520 now averages all calipered readings, and subtracts the base, so as to store an average thickness for each signature from each feeder box, each standard book, and each book containing all signatures.

A block 522 now adds the average thicknesses of all single signatures, plus the base. The resulting calculated thickness is typically smaller than the average actual thickness for all signatures, as determined by block 518, because of the entrapped air layers between signatures. A box 524 then counts the number of signatures which have been fed to make all signatures, and subtracts one to obtain the number of air interfaces between signatures. For example, if 27 feeders were actuated, there will be 26 air interfaces between signatures. A block 526 now calculates the "air factor" for each interface, i.e. the thickness of the entrapped air layer, by subtracting the calculated thickness, determined by block 522, from the actual thickness, determined by block 518 (as average by block 520), and divides the result by the number of interfaces determined by block 524. A block 528 then adds the air factor to the average of each individual signature thickness as determined by block 514 and averaged by block 520. The stored value now gives a compensated value for each signature which can be fed, based on the air interface which had been measured during the make-ready mode.

The stored values for each signature are maintained in a look-up table which can be accessed by the box feed task 242, FIG. 14. When a particular box feeds, the calculated stored value is then added by block 277, FIG. 14, to word 5 so as to maintain a running total of the expected book thickness. At the end of passing all signature feeders, word 5 will thus contain a sum of all stored values for all actuated feeders. This is compared with the actual caliper thickness, stored in word 6, to determine a caliper error.

Returning to FIG. 17, the stored values are now used to determine the tolerances and the initial floating factor which will be stored until changed during a production run. A block 530 determines a thick tolerance which is equal to the smallest one of all the stored individual signatures after the air factor has been added by block 528. If a subsequent caliper reading exceeds the thick tolerance (as adjusted by the floating factor), it means that an additional signature has been fed to the book. In the past, the thick tolerance has been typically set at two signatures because a greater safety margin was necessary due to the absence of special compensations such as the air factor and the floating factor.

A block 532 then calculates a thin tolerance as one-half of the thick tolerance determined by block 530. A subsequent caliper reading, smaller than the expected caliper reading minus the thin tolerance, means that a signature is missing. Again, it has been conventional to establish a much longer thin tolerance, equal to one signature, because of the lack of compensation provided by the present invention.

A block 534 then adds the thickness of all individual signatures in the hopper book, which includes the base and air factor, and stores the sum as a calculated hopper thickness. This calculated hopper thickness should be almost equal to the measured hopper thickness, block 516, because the air factor is included therein. A block 536 then subtracts the actual hopper thickness from the calculated hopper thickness to determine an initial "floating factor" which will be used during a production run. This floating factor is used by the caliper task 250, FIG. 18, to compensate for slowly changing conditions such as temperature and humidity or ink conditions which may vary slowly during the day. When books are calipered, as will appear, a variation beyond the thick or thin tolerance is then adjusted by the floating factor so as to take into account the current humidity, temperature, ink changes and the like. The floating factor is recalculated after every seven books, as will appear, and thus block 536 is used to establish the initial floating factor used until seven books are made. The make-ready mode then returns to home routine 206 so that a different mode can be selected by the operator.

Figure 18:
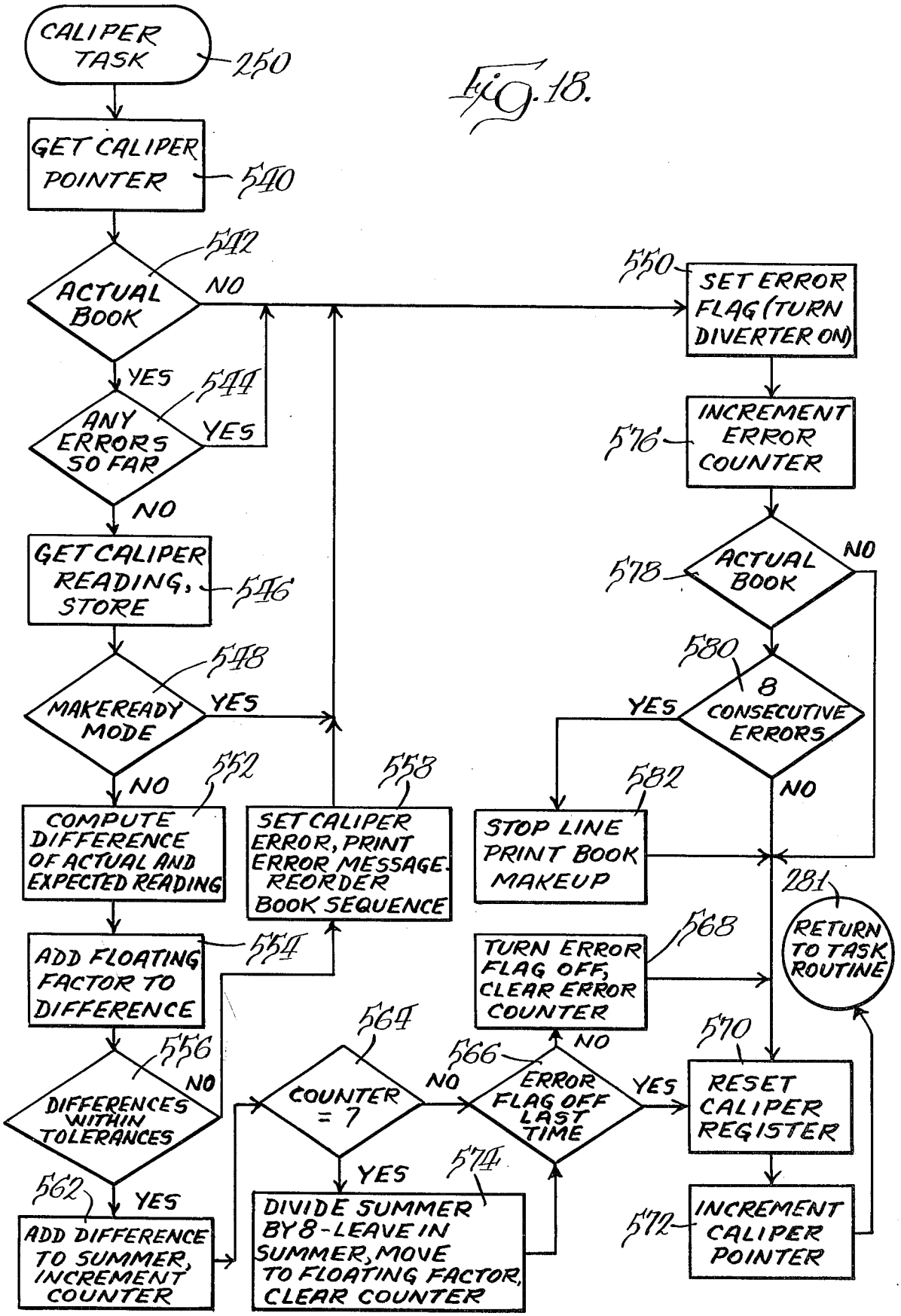
FIG. 18 is a logic flow chart of the caliper task of the control program.

During a production mode, the caliper 64 generates an interrupt, as previous explained, which causes the caliper task 250, FIG. 18, to be serviced. A block 540 obtains the caliper pointer from the ring buffer 150, after which a block 542 determines whether an actual book is being made as indicated by word 1 associated with the book of signatures then adjacent the caliper pointer. A block 544 then determines whether there are any errors in word 7. If not, a block 546 obtains the caliper reading from interface C, FIG. 9, and stores it in word 6. A decision block 548 now determines whether we are in the make-ready mode, as indicated by word 1. If this was the make-ready mode, block 548 would pass control to an error block 550 which would set bit 4, caliper error, in word 7. This in turn would disable the stitcher and cause the diverter 76 to reject the book of signatures, as is desired since they are not intended to result in output books.

When in the production mode, block 548 passes control to a block 552, FIG. 18, which now computes the difference between the actual reading, stored in word 6, and the expected reading, stored in word 5. A block 554 then adds the floating factor, originally determined by block 536 of FIG. 17, to the difference obtained by block 552. The different plus floating factor is then analyzed by a block 556 to determine whether it is greater than the thick tolerance or less than the thin tolerance, established by the make-ready mode, FIG. 17. If the tolerances are exceeded, a block 558 sets bit 4, caliper error, in word 7, and passes control to an error routine 560, FIG. 19, which then passes control to the reorder book sequence 670, FIG. 20. If the reorder book sequence 670 determines that the book can be reordered, bit 15 of word 7 is set. This bit prevents operation of the stitcher and diverts the book to the reject books station. The replacement book feeder does not feed the replacement book when bit 15 of word 7 is set, because the book has been reordered. Alternatively, if the reorder book sequence 670 determines not to reorder, then bit 15 of word 7 is not set. In this case, the caliper error bit 4 prevents operation of the stitcher and causes the book to be diverted to the reject books station. However, when the empty conveyor station reaches the replacement book feeder, a standard replacement book will be fed because bit 15 of word 7 was not set.

Returning to the caliper task, FIG. 18, block 556 passes control to a block 562 when the difference plus float factor is within the thick and thin tolerances. The difference is added to a summer (which initially stored the float factor determined by block 536, FIG. 17). A summer counter is then incremented and a block 564 determines whether it has been incremented by seven counts. If not, a block 556 insures that the error flags are off, via a block 568 if the error flags had been turned on previously, and a block 570 resets the caliper register. The caliper pointer is then incremented by a block 572 and return is passed to the task routine 281.

If the summer counter had been incremented to seven, as determined by block 564, then a block 574 divides the contents of the summer by 8 (the floating factor being in effect the eighth number stored therein), and leaves the result in the summer. This result also is used as the new floating factor which is added by block 554 until changed again. The counter is returned to zero, but the summer still contains the new floating factor. Thus, the floating factor is continuously updated for every seven book of signatures which are made. This adjusts the caliper for gradual atmospheric changes, ink changes, and the like.

When the error flag box 550 is actuated, FIG. 18, a block 576 increments an error counter and a block 578 determines whether an actual book is being made. If not, such as in mode 01, it is not truely an error and control passes to the reset register block 570. If a book is being made, a true error is present and a block 580 determines whether eight consecutive errors have occurred. If so, a block 582 stops the entire collating system, and prints on the TTY the book make-up which includes a list of the box feeders that should have fed for the book then located at the caliper station. This allows the operator to manually check the contents of the caliper book, and determine what is causing the error.

Figure 19:
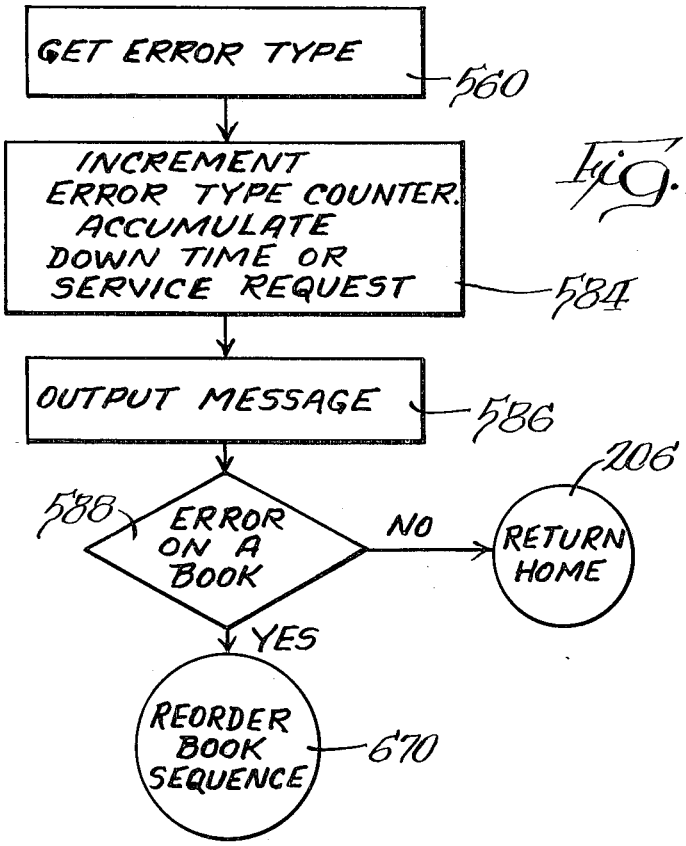
FIG. 19 is a logic flow chart of the error message module of the control program.

When a caliper error is detected by block 558, control passes to the error routine 560, FIG. 19. A block 584 then increments the error counter for that particular type of error and accumulates the down time or services any requests. A message output block 586 then outputs an appropriate message to the TTY or CRT. A block 588 then determines whether the error was due to a book. Since it was in the present example, control passes to the reorder book sequence 670, which will be explained later with respect to FIG. 20.

AUTOMATIC HOPPER REFILL

Figure 6:
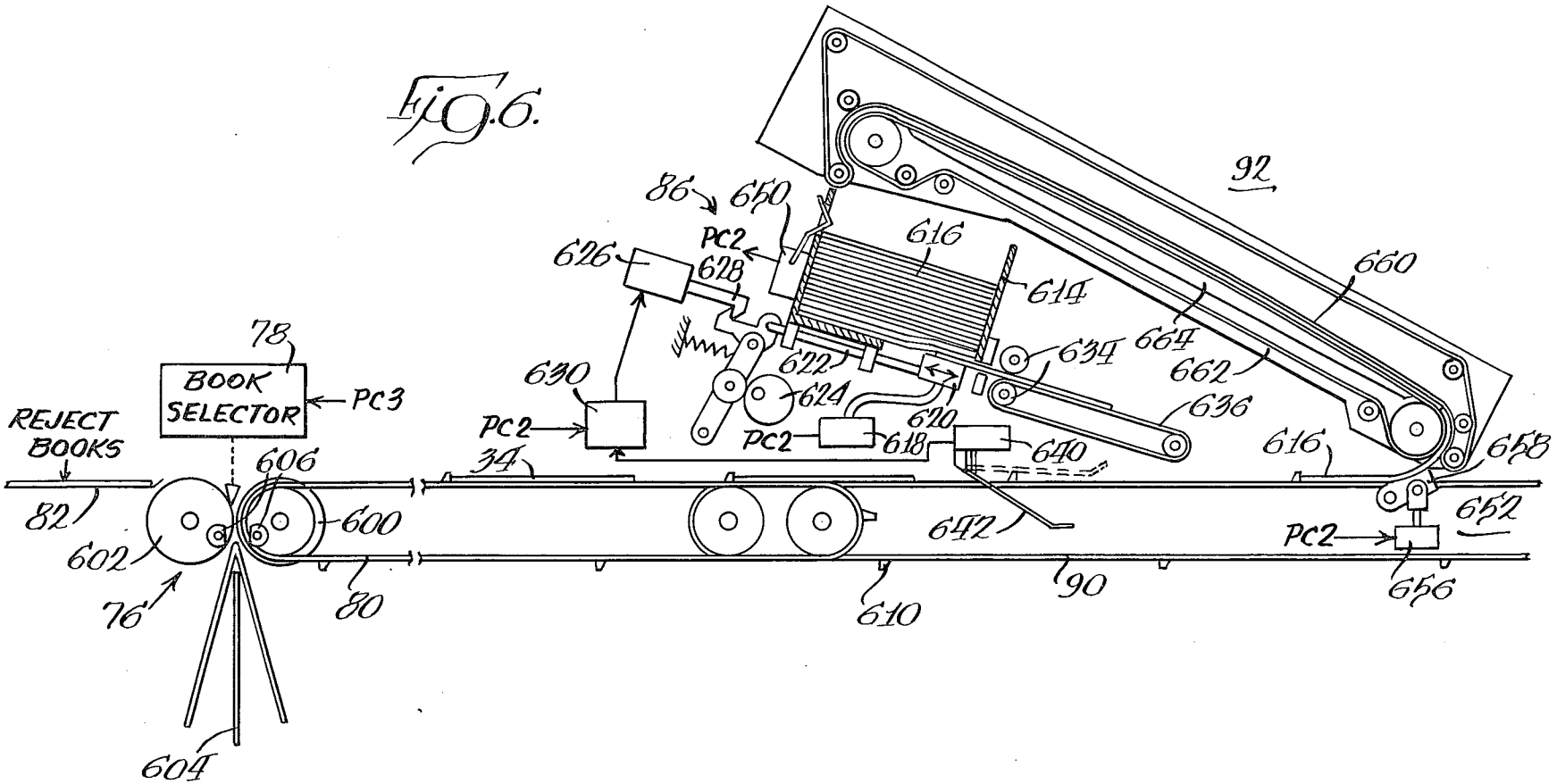
FIG. 6 is a diagramatic view of the replacement book feeder and auto hopper, and portions of the diverter and reject books station, shown in FIG. 1.

In FIG. 6, the replacement book feeder 86, auto hopper 92, and diverter 76 are shown in detail. The diverter station 76 is conventional and includes a drive roller 600 which conveys books to the trimmer infeed conveyor chain 80, and a drive roller 602 which serves to convey books to the reject books tray 82. A tucker blade mechanism 604 along with pick-up rollers 606 urge the book upwardly to one of the drive rollers 600 or 602. The book selector solenoid 78 then controls which drive rollers are effective to deliver an individual book or group of signatures to the trimmer or to the reject station.

Trimmer infeed chain 80 includes a plurality of lugs which carry the book into the trimmer's first cutting knife. A pressure belt continues the forward movement of the book into the second set of knives and then releases the book at a point beyond, allowing an outfeed chain with its plurality of lugs to continue the books toward the mailing label printer. A transport chain 90 with a plurality of lugs 610 then overtakes the lugs of the trimmer outfeed chain by means of higher speed as a result of greater spacing of the plurality of lugs. This effectively transfers the book from the trimmer outfeed to the next series of chains, as is conventional. The chains consist of spaced belts which carry the signatures 34 toward the label printer.

The replacement book feeder 86 is improved over the replacement book feeder shown in U.S. Pat. No. 3,899,165, assigned to the assignee of the present application. The improvement includes an automatic hopper 92 which is refilled with standard books of signatures whenever the number of stored standard books drops below a preselected value.

A book hopper 614 stores a plurality of standard replacement books 616, also called hopper books, containing the combination of signatures determined by the settings of the switch matrix 166, as previously explained. A solenoid valve 618 controls the application of vacuum at a vacuum slide 620 which is reciprocally driven by a link 622 under control of a shuttle cam 624 when unlatched. A latch consists of a latch solenoid 626 which lifts a latch arm 628 when an actuation signal is received from an AND gate 630.

When unlatched, link 622 and connected vacuum slide 620 are moved to the right, as illustrated in FIG. 6, thereby moving the lowermost replacement book into engagement with feeder rollers 634. As the replacement book is grabbed by the feeder rollers 634, the solenoid 618 releases the vacuum on the vacuum slide 620. The replacement book 616 is then conveyed onto a belt 636 and is carried forward until it falls onto an empty conveyor station. Meanwhile, the shuttle cam 624 moves the vacuum slide 620 back to its rest position, where it is latched.

An empty conveyor station detector is formed by a switch 640 having an arm extension 642 which lowers whenever no book is adjacent thereto. This delivers a signal to the AND gate 630 to actuate latch 624 when a replacement book signal is also present, from the programmable controller.

A minimum pile height detector 650 detects when the pile height within the hopper 614 falls below a predetermined level. This provides a signal to the programmable controller to reorder a number of standard replacement books, the number being preset by the operator, as will be explained. When the replacement or hopper books reach a divert station 652, as detected by the hopper refill pointer 654 of the ring buffer 150, a signal transmitted via the programmable controller energizes a solenoid 656 which causes a divert gate 658 to divert the signatures from the main stream of the conveyor and into the auto hopper 92.

The auto hopper 92 includes an upper pressure belt 660 and a lower pressure belt 662 which convey the hopper signatures 616 into the hopper 614 with the proper orientation for subsequent delivery to an empty conveyor station. A base support 664 for the lower pressure belt 662 has an arched top surface which maintains the proper pressure on the signatures throughout the path of travel into the hopper 614.

Figure 20:
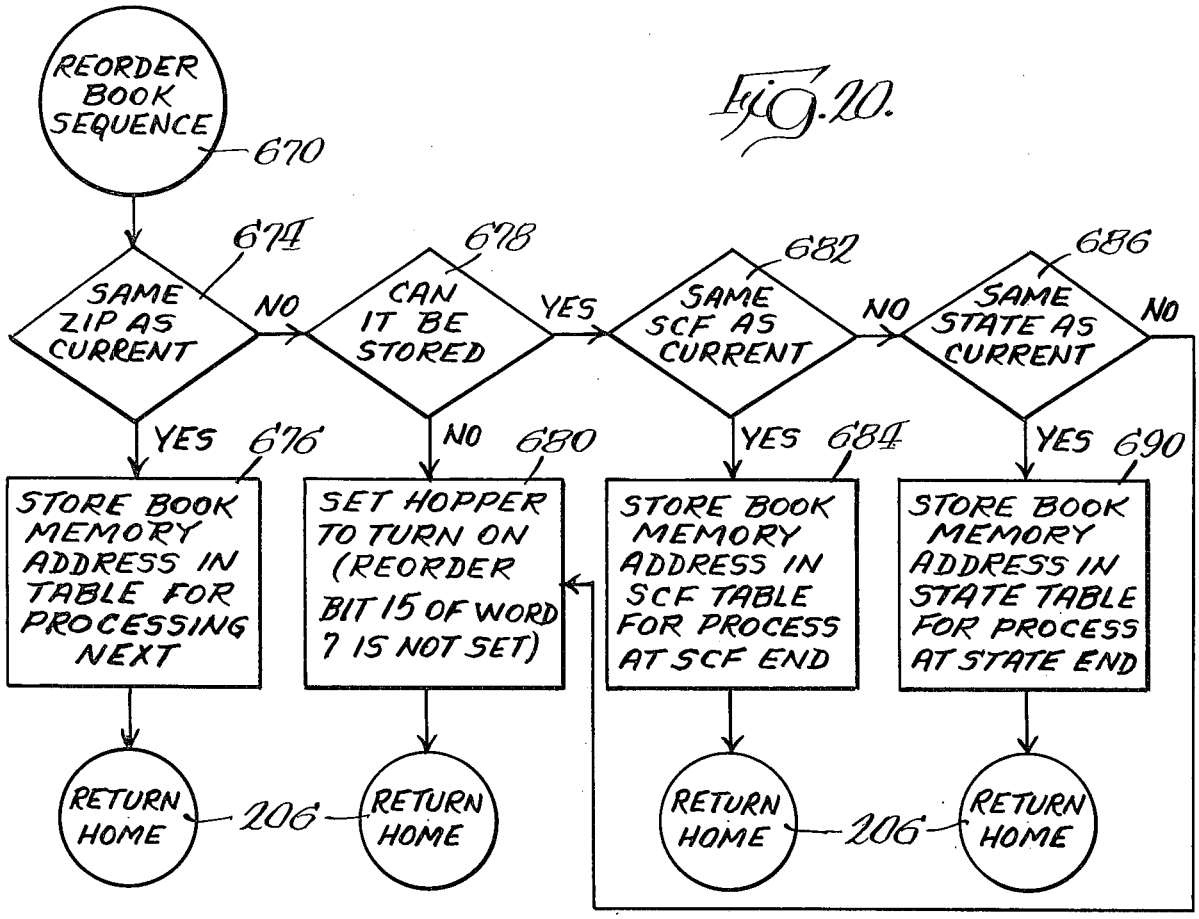
FIG. 20 is a logic flow chart of the reorder book sequence module of the control program.

Control over whether a rejected book should be filled by a standard replacement book, or should be reordered, is determined by the reorder book sequence module 670, FIG. 20. This module is entered at the time an error is detected. If the module determines, as will be explained, that the book for which an error occurred should be reordered, than bit 15 of word 7 is set at the time the book is reordered. Each time a new conveyor station reaches the hopper pointer 672, FIG. 10, the presence of the reorder book bit 15 in word 7 is checked. If the bit is not set, a replacement book signal is sent via the programmable controller to the AND gate 630, FIG. 6. If the conveyor station is empty at this time, the AND gate is enabled to feed a replacement book to the empty conveyor space. If reorder book bit 15 of word 7 was present, then no replacement book signal is transmitted and the AND gate 630, FIG. 6, cannot be enabled even though the conveyor space is empty.

Whenever an error is first detected, such as by a detector 48 of FIG. 1 when a signature should have been fed, an error interrupt is posted which is serviced by the error routine, FIG. 19, as previously explained. When the error results in a defective book, a flag is posted to reject the book of signatures by the diverter 76 (assuming the defect has occurred prior to this time), and the reorder book sequence 670, FIG. 20, is entered. A decision block 674 determines whether the zip code, as contained in words 164–168 stored in memory location where the error has occurred, is the same as the zip code contained in words 164–168 for the book now at the box 1 feeder. If affirmative, a block 676 stores the book memory address in a table for processing next, in place of reading the next subscriber information from magnetic tape. At the same time, bit 15 of word 7 is set to indicate that the book has been reordered. The same group of signatures will thus be reassembled, and if no errors occur, will be passed to the printers where the words 8–168 will cause the correct mailing information and other custom printing to be printed thereon.

If the zip code is not the same as that being processed at the beginning of the collating line, a decision block 678 makes a preliminary determination whether the book memory address can still be stored in the table. This is accomplished by looking at the first digit of the zip code. If the first digit is different than the first digit now being processed, a block 680 sets the hopper to turn on later, by not placing any enabling signal in bit 15 of word 7.

If decision block 678 determines that the first digit of the zip code is the same as that being processed, control passes to a decision block 682 which determines whether the sectional center facility (SCF) code is the same as that currently being run at the first feeder. The SCF code is the first three digits of the zip code. If affirmative, a block 684 stores the book memory address in a special SCF table for processing just prior to a change in the SCF code, and the reorder book bit 15 of word 7 is set.

If the first three digits are not the same, control passes to a decision block 666 which determines from the two letters indicating the state, whether the state is still the same as that being run at the beginning of the collating line. If affirmative, a block 690 stores the book memory address in a state table for processing just prior to a change in the state as read by the magnetic tape reader. Bit 15 of word 7 is also set. If negative, the book cannot be reordered while still maintaining the desired mailing sequence, and therefore block 686 passes control to block 680 which returns to the home routine 206, without setting bit 15 of word 7 so that the conveyor station, when eventually reaching the replacement book feeder station, will receive a standard replacement book.

The number of replacement signatures 616 automatically reordered for the hopper 614, FIG. 6, can be varied by the operator. When the line is not running, the operator can type in a CH request on teletype 128, indicating that he desires to change the number of hopper books. The CH operator message generates an interrupt 700 which is processed by an operator message module, FIG. 21. A block 702 retrieves the CH code, in ASCII characters, and determines in a block 704 if the code is valid. If so, the code is echoed back by block 706 to the originating terminal as an error check.

The characters in the message are checked by blocks 708 and 710 to determine the code meaning. When the code is detected as CH, block 708 branches to a change hopper subroutine. A block 712 determines if any books are currently being made. If not, block 714 stops the line, should it be moving, and transmits an OK message to the TTY 128. The operator now enters a number corresponding to desired hopper count, that is, the number of signatures which will be reordered and diverted to the auto hopper 92 each time the hopper low signal occurs. This number is read by a block 716 and is converted by block 718 from ASCII, supplied by the TTY, into integer form as is used by the control program. The integer value is then stored by block 720 in a hopper variable table. When the hopper low signal is received, a number of hopper books equal to the number in the hopper variable table will then be automatically made and diverted to the auto hopper 92.

KICKER

Figure 7:
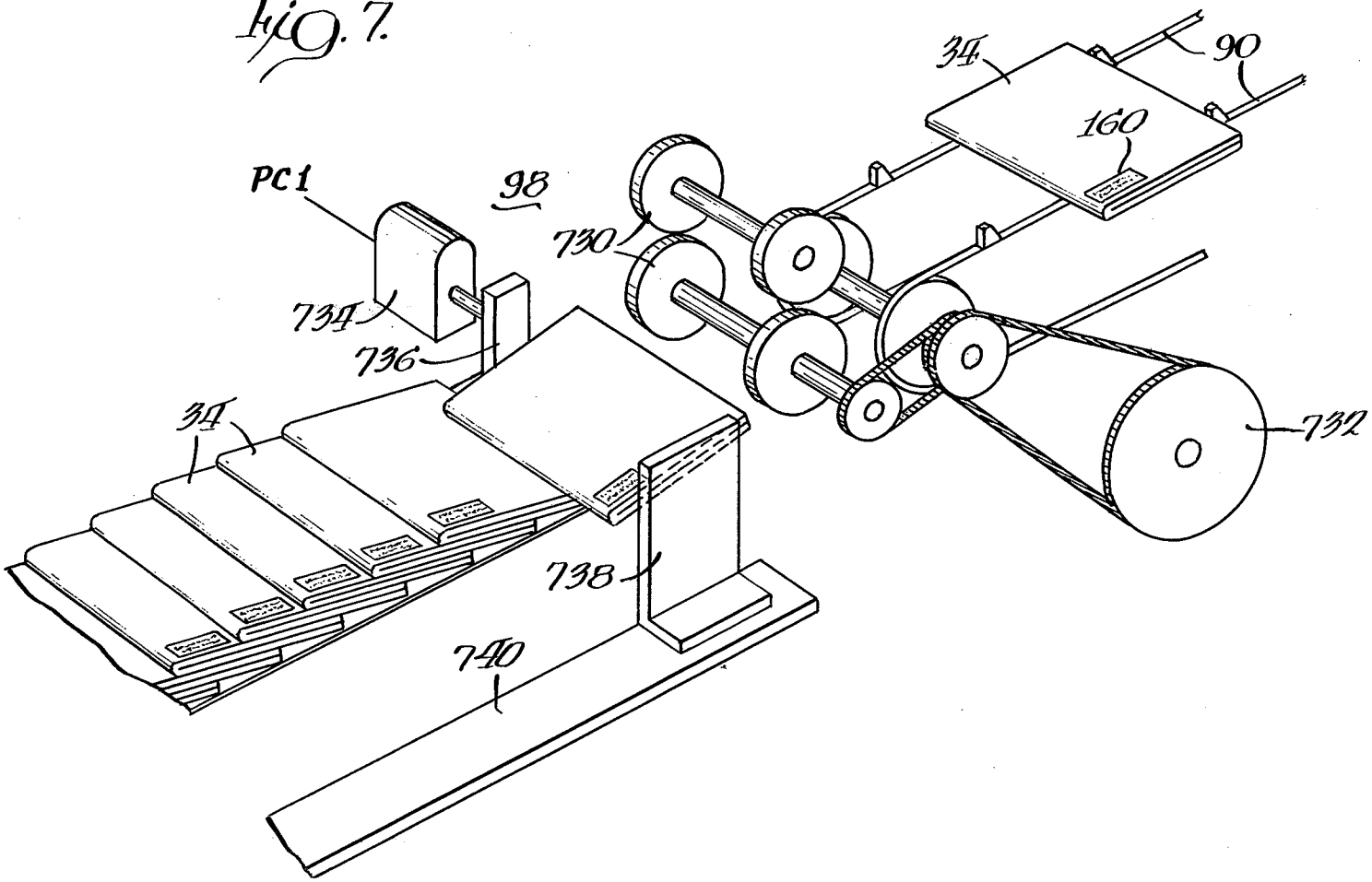
FIG. 7 is a diagramatic view of the kicker shown in FIG. 1.

The kicker station 98 is shown in detail in FIG. 7. As the signatures 34 reach the end of the output chain 90, they are ejected onto a shingled stream by a pair of pinch rollers 730. The pinch rollers are driven through chains associated with the printing station drive 732. The usual trajectory of the books is altered when a kicker solenoid 734, energized from the programmable controller, extends an inclined plate 736 into the trajectory path. This diverts the signatures towards the kicker stop plate 738 affixed to the mounting plate 740 for the output station. The displaced books within the shingled stream of books is thus easily distinguished to determine the reason for special handling.

Figure 22:
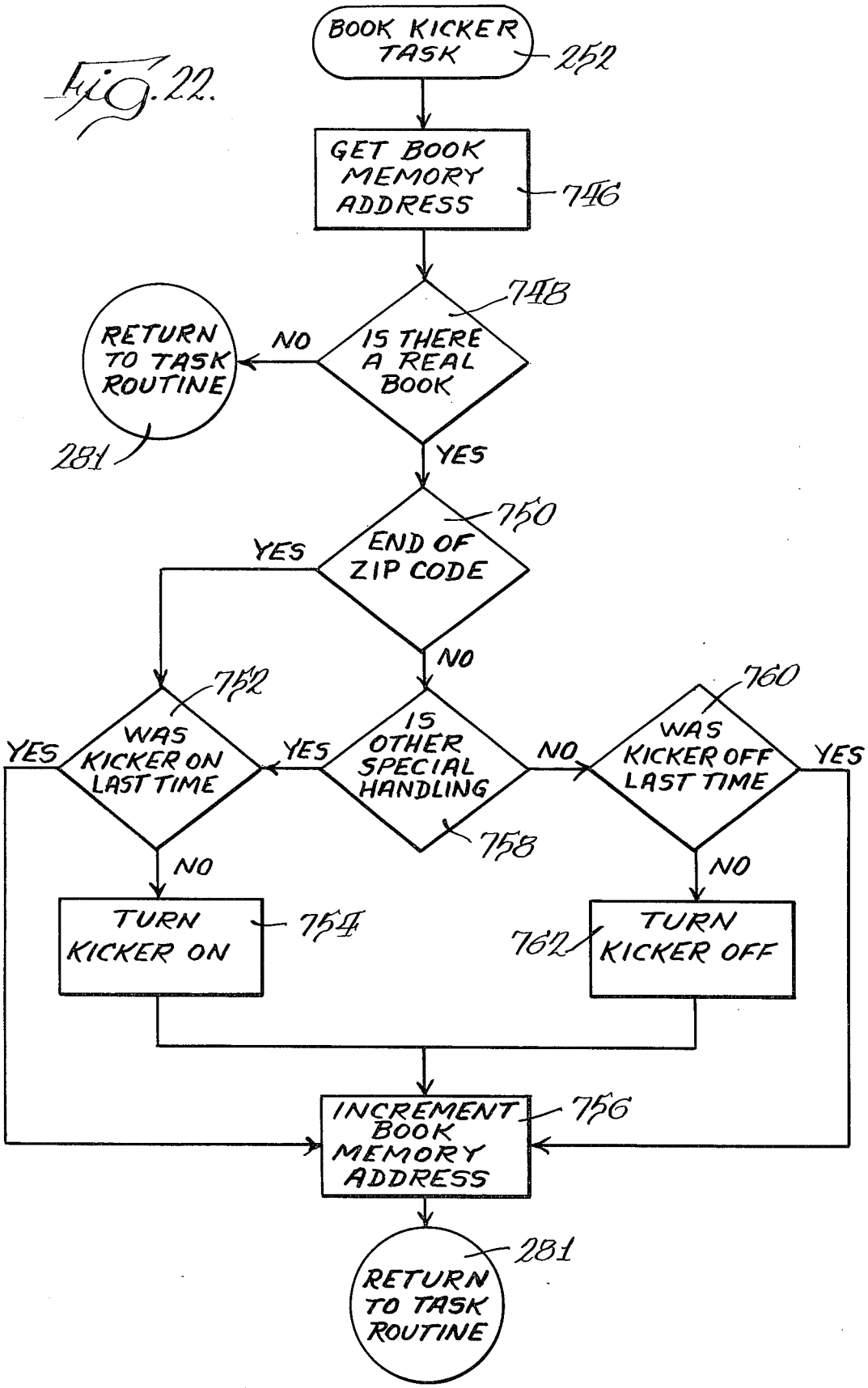
FIG. 22 is a logic flow chart of the book kicker task of the control program.

Kicker station 98 is controlled by the book kicker task 252, FIG. 22. When this task is executed, a block 746 retrieves the memory address of the book then adjacent the book kicker pointer 154. Block 748 then determines whether a real book is present, as indicated by the code within word 1. A block 750 then checks whether the end of a zip code, contained in words 164–168, has been reached with respect to the zip code contained in the next upstream book. If so, a block 752 determines whether the kicker was previously on. If not, a block 754 sends a message to the programmable controller which in turn energizes solenoid 734 thus extending the inclined plate 736. A block 756 then increments the book memory address after which control is passed to the task routine.

If an end of zip code is not determined by block 750, a block 758 then determines the presence of various other special conditions which require the kicker to displace the book. For example, the books leaving the line may be summed or categorized, and every fixed number of books may be kicked in conjunction with a stacker. If the scanner 96 determines a printing error, block 758 passes control to block 752. In addition, a "quality" book is kicked at the end of each zip code run for quality control purposes. Additional books may be kicked for office copies. Such quality books or office copies are extra books collated by the system, the number of which are determine through entry on the teletype TTY. If no such special conditions are present, block 752 passes control to a decision block 760 which determines whether the kicker was off the last time. If not, a block 762 turns the kicker off, thereby causing the programmable controller to generate a signal which deenergizes the solenoid 134.

In addition to the above described devices, other devices conventional on collating lines may be utilized, and/or the devices described herein can be used in various combinations, following the above teachings.

We claim:

1. A collating system for gathering groups of signatures with internal signatures of the groups having customized printing, comprising:

a collating conveyor having spaced stations which sequentially receive signatures to progressively build the groups of signatures, a plurality of feeder means spaced along the collating conveyor for delivering signatures to adjacent stations of the collating conveyor, signature printer means located intermediate of the plurality of feeder means and having a printer head adjacent the collating conveyor for printing information on the signature fed from a preceeding feeder means, the printed information being covered by the signature fed by a subsequent feeder means, and source means synchronized with operation of the collating conveyor for sequentially coupling to the signature printer means information which is to be printed on the signatures fed from said preceeding feeder means.

2. The collating system of claim 1 wherein the source means contains a series of different subscriber information, means for coupling at least a portion of the subscriber information to the signature printer means for printing different information on successive groups of signatures, and label printer means coupled to the source means for printing mailing information based on the same subscriber information which controlled the signature printer means when the corresponding group of signatures was adjacent to the signature printer means.

3. The collating system of claim 1 wherein the collating conveyor includes primary drive means for moving the spaced stations past each of the plurality of feeder means, and the signature printer means includes auxiliary drive means for driving the group of signatures while adjacent the printer head to maintain a desired speed for the group of signatures.

4. The collating system of claim 1 wherein the printer head comprises a noncontact printing head spaced from the signature to be printed including a source of ink droplets projected from the noncontact printing head to the signature, and means for forming the ink droplets into characters in accordance with the information from the source means.

5. The collating system of claim 4 wherein the noncontact printing head comprises an ink-jet head for projecting dots of ink along a direction transverse to the direction of movement of the collating conveyor, a matrix of dots of ink being formed as the collating conveyor moves the signature past the ink-jet head.

6. The collating system of claim 1 including optical scanner means adjacent the collating conveyor and downstream of the printer head for generating a signal related to the presence or absence of printed information on the signature which was to have been printed, comparison means coupled to the optical scanner means and the source means for generating an error signal when printed information is absent when it should have been printed, and reject means for rejecting the group of signatures from the collating conveyor when the group of signatures reaches a reject station.

7. The collating system of claim 6 including reorder means responsive to the rejection of a book due to the error signal for selectively actuating the feeder means in response to the same information from the source means as originally controlled the feeder means to build a reorder group of signatures.

8. A collating system comprising:

a conveyor having a direction of movement adjacent a plurality of feeder means which deliver signatures to adjacent stations spaced along the conveyor to progressively build groups of signatures, processing means adjacent the conveyor for processing the groups of signatures to provide output groups of signatures, source means for generating characters which are to be printed on the groups of signatures, and a dot matrix printer head adjacent the conveyor for printing on an adjacent signature a plurality of dots along a direction transverse to the direction of movement of the conveyor, a matrix of dots being formed as the conveyor moves the adjacent signature past the dot printer head, the printer head being coupled to the source means and operated in synchronism with the conveyor for selectively printing dots in a matrix which forms the characters to be printed.

9. The collating system of claim 8 wherein the plurality of feeder means are selectively actuated to progressively build different groups of signatures having different thicknesses, and adjustment means cooperating with the dot printer head to maintain the adjacent signature directly facing the dot printer head at a constant distance therefrom despite variations in the thickness of the group of signatures.

10. The collating system of claim 9 wherein the adjustment means includes a pressure plate located between the dot printer head and the adjacent signature for establishing the constant distance, and spring biased means for urging the group of signatures against the pressure plate.

11. The collating system of claim 10 including a plurality of dot printer heads located adjacent the conveyor, a mounting plate for maintaining the dot printer heads at a fixed distance from the pressure plate and each offset along the transverse direction so as to form a different line of printing, and a plurality of spring biased means each coaxial with a different one of the dot printer heads for urging the portion of the signature adjacent thereto against the pressure plate.

12. The collating system of claim 8 including a plurality of dot printer heads adjacent the conveyor, mounting means for maintaining the plurality of dot printer heads offset along the transverse direction to each print a different line of information, all of the plurality of dot printer heads being coupled to the source means for selectively printing a plurality of lines of characters.

13. The collating system of claim 8 wherein the dot printer head comprises an ink-jet head for projecting a stream of ink dots against the adjacent signature.

14. The collating system of claim 8 including main drive means for moving the conveyor past the plurality of feeder means, and auxiliary drive means adjacent the dot printer head for separately moving the group if signatures adjacent thereto, the auxiliary drive means returning the signatures for movement under the main drive means after passing the dot printer head.

15. A signature handling system comprising:

a conveyor for moving groups of spaced signature adjacent a plurality of feeder means and processing means for feeding signatures to progressively build the groups of signatures and for processing the groups of signatures, source means for generating characters which are to be printed in different combinations on the groups of signatures, printer means adjacent the conveyor and responsive to the source means for printing the different combinations of characters on the groups of signatures carried by the conveyor, scanner means adjacent the conveyor downstream of the printer means for scanning the printed characters to generate a signal related to the presence or absence of characters, and comparison means coupled to the scanner means and the source means for generating a control signal indicating the actual presence or absence of scanned characters when characters were to be printed.

16. The signature handling system of claim 15 wherein the source means includes decision means for determining whether one or more characters were to be printed within a single line, and the comparison means provides an error control signal whenever the scanner means detects no characters in the single line when the decision means determines that one or more characters should have been printed.

17. The signature handling system of claim 16 wherein the scanner means has a scanning head extending a length of the single line so that the signal therefrom represents the presence or absence of any characters along the entire length of the scanning head.

18. The signature handling system of claim 15 wherein the scanner means includes a line optical scanner located for scanning printed characters along a line and a background optical scanner located for scanning primarily the background against which the characters are printed, the line scanner and the background scanner being coupled to subtraction means for subtracting the background from the signal produced by the line scanner, the output of the subtraction means being coupled to the comparison means.

19. The signature handling system of claim 18 including at least one additional line scanner located for scanning a printed chracter along a different line than the first named line scanner, the background scanner being located to scan across both lines of printing to generate a background signal, additional subtraction means coupled to the additional line scanner means and the background scanner for subtracting the background from the signal produced by the additional line scanner, and additional comparison means coupled to the output of the additional subtraction means and the source means for generating a control signal indicating the actual presence or absence of scanned characters along the different lines of printing.

20. A collating system comprising:

a plurality of feeder means for delivering signatures to adjacent stations spaced along a conveyor, one of the plurality of feeder means including a hopper for storing a plurality of signatures and delivery means selectively actuable to feed signatures from the hopper to the conveyor, diverter means selectively actuable to divert signatures from the conveyor into the hopper, and control means for selectively actuating the diverter means to automatically refill the hopper with signatures from the conveyor.

21. The collating system of claim 20 including reject means actuable to reject a defective group of signatures from the conveyor to create an open station, said one feeder means being located downstream of at least some of the plurality of feeder means, the control means actuating the diverter means to fill the hopper with replacement groups of signatures being transported by the conveyor from upstream feeder means, and the control means actuating the delivery means to fill the open station with the replacement group of signatures from the hopper.

22. The collating system of claim 21 wherein the hopper includes a hopper level detector for detecting when the signatures in the hopper fall below a preselected amount, and the control means includes reorder means responsive to the hopper level detector for actuating the upstream feeder means to automatically build replacement signatures which are then diverted by the diverter means into the hopper.

23. The collating system of claim 22 wherein the plurality of feeder means are selectively actuable to gather different groups of signatures, source means for establishing the different combinations of feeder means which are to be actuated to progressively build different groups of signatures, standard means for establishing particular feeder means which are to be actuated to build a standard group of signatures, and the reorder means actuates the standard means in order to generate standard replacement groups of signatures to fill the hopper.

24. The collating system of claim 20 wherein the control means includes means for initially selecting an amount of signatures to be diverted to the hopper, a hopper level detector for detecting when the signatures in the hopper fall below a preselected amount, and reorder means responsive to the hopper level detector for actuating the feeder means to build signatures equal to the initially selected amount.

25. A collating system comprising:

a plurality of feeder means selectively actuable to deliver signatures to a conveyor to progressively build groups of signatures, source means for establishing coded data which controls actuation of the feeder means to build different groups of signatures in response to different coded data, reject means for rejecting a defective group of signatures, reorder means for selectively actuating the feeder means under control of the coded data corresponding to a rejected group of signatures to progressively rebuild the same group of signatures as rejected, logic means coupled to the source means for analyzing the coded data to determine whether certain digits of the mailing address of a rejected group of signatures have preselected relationships to corresponding digits of the mailing address of the groups of signatures then being delivered by the plurality of feeder means, including first decision means responsive to a match of the digits for actuating the reorder means during the existence of the match, and second decision means responsive to a match with only a predetermined lesser portion of the digits for actuating the reorder means at a later time prior to a change in the predetermined lesser portion of the corresponding digits.

26. The collating system of claim 25 wherein the logic means includes negative means responsive to a lack of correlation with the preselected relationship for actuating replacement means which deliver to the conveyor one of a plurality of standard replacement groups of signatures.

27. A collating system comprising:

a plurality of feeder means selectively actuable to deliver signatures to a conveyor to progressively build groups of signatures, source means for establishing coded data which controls actuation of the feeder means to build different groups of signatures in response to different coded data, reject means for rejecting a defective group of signatures, replacement means having a hopper storing a plurality of standard replacement groups of signatures, delivery means for delivering one of the standard replacement groups of signatures to the conveyor, diverter means selectively actuable to divert groups of signatures from the conveyor into the hopper, a low level detector for determining when the plurality of standard replacement groups of signatures in the hopper is below a preselected value, replacement recorder means for selectively actuating the feeder means under control of coded data representing a standard group of signatures to progressively build new standard replacement groups of signatures and for actuating the diverter means when the new standard replacement groups of signatures on the conveyor reach the diverter means, and logic means coupled to the source means for actuating the replacement means when the reject means rejects a defective group of signatures.

28. In a collating system having a plurality of feeder means each actuable to deliver signatures to a collating conveyor to progressively build groups of signatures, source means for establishing different coded data representing different groups of signatures which are to be progressively built, control means for selectively actuating the plurality of feeder means in response to the different coded data to progressively build the different groups of signatures, the different groups having different thicknesses depending on the different combinations of signatures therein, caliper means for measuring the thickness of each group of signatures on the collating conveyor, calculation means for calculating a thickness for each group of signatures which were to be built in reponse to the coded data, and comparing means for comparing the calculated thickness with the caliper thickness to generate a difference, the improvement comprising:

compensation means responsive to the caliper means and the calculation means for generating a thickness correction, tolerance means for establishing a tolerance level for the caliper thickness, and error means for indicating an error when the difference is more than the tolerance level adjusted by the thickness correction.

29. The collating system of claim 28 wherein the compensation means effectively subtracts the calculated thickness from the calipered thickness and divides the result by the number of signatures in the group minus one to generate a thickness correction equal to the air layer between adjacent signatures.

30. The collating system of claim 29 wherein the compensation means establishes a floating factor by generating the thickness correction each time a preselected number of groups of signatures have passed the caliper means to thereby update the previous thickness correction.

31. The collating system of claim 28 including make-ready means for actuating the plurality of feeder means to progressively deliver single signatures from the feeder means to the collating conveyor for measurement by the caliper means, the tolerance means establishes a thick tolerance approximately equal to the smallest thickness signature which was measured during operation of the make-ready means and a thin tolerance equal to substantially less than the thick tolerance, error means generating the error when the difference adjusted by the thickness correction exceeds the thick tolerance or is less than the thin tolerance.

* * * * *

REEXAMINATION CERTIFICATE (879th)

United States Patent [19]

Riley et al.

[11] B1 4,121,818

[45] Certificate Issued Jun. 28, 1988

[54] SIGNATURE COLLATING AND BINDING SYSTEM

[75] Inventors: Wayne A. Riley, Hazelcrest; Melinda S. Ingebretsen, Downers Grove; Robert I. Rodig, Barrington; David V. Krapf, South Holland; Donald E. Hagenbart, Oak Forest; Charles H. Williams, Chicago, all of Ill.

[73] Assignee: R. R. Donnelley & Sons Co., Chicago, Ill.

Reexamination Request:
No. 90/001,302, Aug. 6, 1987

Reexamination Certificate for:

| | |
|---|---|
| Patent No.: | **4,121,818** |
| Issued: | **Oct. 24, 1978** |
| Appl. No.: | **856,911** |
| Filed: | **Dec. 2, 1977** |

Related U.S. Application Data

[63] Continuation of Ser. No. 709,492, Jul. 28, 1976, abandoned.

[51] Int. Cl.[4] ..... B65H 39/02
[52] U.S. Cl. ..... 270/54; 270/58
[58] Field of Search ..... 270/1, 4, 12, 18, 21.1, 270/32, 54–58; 400/126; 346/75

[56] References Cited

U.S. PATENT DOCUMENTS

| | | | |
|---|---|---|---|
| 3,803,628 | 4/1974 | Van Brimer et al. | 346/75 X |
| 3,819,173 | 6/1974 | Anderson | 23/54 |
| 3,869,986 | 3/1975 | Hubbard | 101/91 |
| 3,899,165 | 8/1975 | Abraham | 270/54 |
| 3,899,381 | 8/1912 | O'Brien et al. | 270/37 X |
| 3,902,708 | 9/1975 | Wise et al. | 270/58 |
| 3,911,818 | 10/1975 | MacIlvaine . | |
| 3,913,719 | 10/1975 | Frey . | |
| 3,917,252 | 11/1975 | Harder | 270/58 |
| 3,953,017 | 4/1976 | Wise | 270/54 |
| 3,982,744 | 9/1976 | Kraynak | 270/54 |
| 4,029,006 | 6/1977 | Mercer . | |

*Primary Examiner*—E. H. Eickholt

[57] ABSTRACT

Each signature feeder along a collating conveyor is selectively actuated under control of coded signals containing mailing information. A dot matrix printer, located between the feeders, is responsive to the coded signals to selectively print custom information within books of signatures. A second dot matrix printer, located after the stitcher and trimmer, prints mailing labels under control of the coded signals. Optical scanners located downstream of the dot matrix printers scan each line of possible printing to detect printing errors. A replacement book feeder, which inserts standard replacement books to fill empty spaces left by rejected books, has a hopper which is automatically refilled by diverting books of signatures from the conveyor. The entire collating line is controlled by a programmable controller and a computer which also reorders or replaces defective books of signatures, compensates for variations in calipered signature thickness, and controls other special handling procedures.

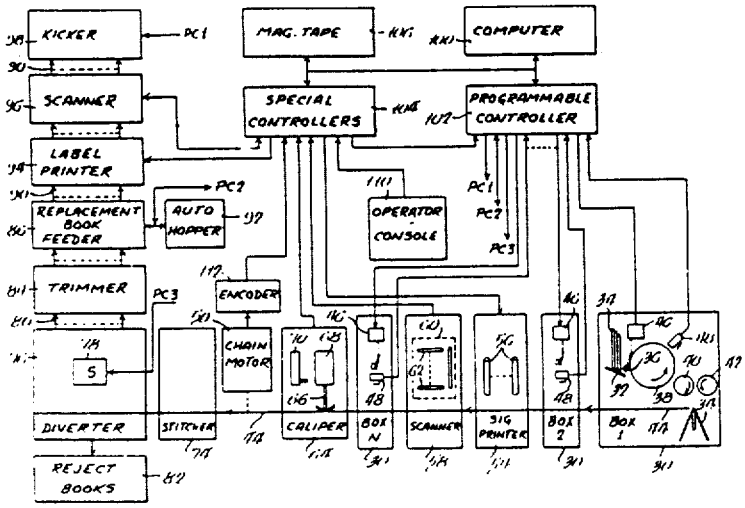

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–31 is confirmed.

New claims 32–43 are added and determined to be patentable.

*32. The collating system of claim 8 in which the dot matrix printer head is mounted to print a plurality of lines of information, each line extending in the direction of movement of the conveyor and the lines being offset from each other along the direction transverse to the direction of movement of the conveyor, the printer head being coupled to the source means for selectively printing matrixes of dots in a plurality of lines of characters.*

*33. A collating system comprising:*

*a conveyor having a direction of movement adjacent a plurality of feeder means which deliver signatures to adjacent stations spaced along the conveyor to progressively build groups of signatures,*

*processing means adjacent the conveyor for processing the groups of signatures to provide output groups of signatures,*

*source means for establishing coded data which control actuation of the feeder means to build a custom book of different output groups of signatures selected in response to different coded data and for generating characters which are to be printed on the groups of signatures,*

*a dot matrix printer head adjacent the conveyor for printing on an adjacent signature a plurality of dots along a direction transverse to the direction of movement of the conveyor, a matrix of dots being formed as the conveyor moves the adjacent signature past the dot printer head, the printer head being coupled to the source means and operated in synchronism with the conveyor for selectively printing dots in a matrix which forms the characters to be printed in a message coordinated with the custom book.*

*34. The collating system of claim 33 in which the printer head is located after the plurality of feeder means and the printed message includes mailing information for the subscriber of the custom book.*

*35. A collating system comprising:*

*a conveyor having a direction of movement adjacent a plurality of feeder means which deliver signatures to adjacent stations spaced along the conveyor to progressively build groups of signatures,*

*processing means adjacent the conveyor for processing the groups of signatures to provide output groups of signatures,*

*source means for generating characters which are to be printed on the groups of signatures, and*

*a first dot matrix printer head adjacent the conveyor for printing on an adjacent signature a plurality of dots along a direction transverse to the direction of movement of the conveyor, a matrix of dots being formed as the conveyor moves the adjacent signatures past the dot printer head,*

*a second dot matrix printer head adjacent the conveyor for printing on an adjacent signature a plurality of dots along a direction transverse to the direction of movement of the conveyor, a matrix of dots being formed as the conveyor moves the adjacent signature past the dot printer head, each printer head being coupled to the source means and operated in synchronism with the conveyor for selectively printing dots in a matrix which forms the characters to be printed, the adjacent signature on which one of the printer heads prints being inside the output groups of signatures.*

*36. The collating system of claim 35 wherein the source means contains subscriber information, at least a portion of the subscriber information being printed on the respective adjacent signatures by each of the printer heads.*

*37. The collating system of claim 36 in which the other printer head is located after the plurality of feeder means, the adjacent signature on which the other printer head prints being exposed in the output group of signatures and the message printed by the other printer head includes mailing information for the subscriber of the output group of signatures.*

*38. The collating system of claim 35 in which said first and second printer heads are located at different points along the conveyor.*

*39. The collating system of claim 38 in which one of the printer heads is located after the plurality of feeder means and the message printed by said one printer head includes mailing information for the group of signatures.*

*40. The collating system of claim 35 in which the source means contains a series of different subscribed information, means for coupling at least a portion of the subscriber information to each printer head for printing different information on successive groups of signatures, the second printer head printing mailing information on an exposed signature of the output group of signatures, based on the same subscriber information which controlled the first printer head when the corresponding group of signatures was adjacent the first printer head.*

*41. A collating system comprising:*

*a conveyor having a direction of movement adjacent a plurality of feeder means which deliver signatures to adjacent stations spaced along the conveyor to progressively build groups of signatures,*

*processing means adjacent the conveyor for processing the groups of signatures to provide output groups of signatures,*

*source means for establishing coded data which control actuation of the feeder means to build a custom book of different output groups of signatures selected in response to different coded data and for generating characters which are to be printed on the groups of signatures,*

*a first dot matrix printer head adjacent the conveyor for printing on an adjacent signature a plurality of dots along a direction transverse to the direction of movement of the conveyor, a matrix of dots being formed as the conveyor moves the adjacent signature past the dot printer head,*

*a second dot matrix printer head adjacent the conveyor for printing on an adjacent signature a plurality of dots along a direction transverse to the direction of movement of the conveyor, a matrix of dots being*

*formed as the conveyor moves the adjacent signature past the dot printer head, each printer head being coupled to the source means and operated in synchronism with the conveyor for selectively printing dots in a matrix which forms the characters to be printed in messages coordinated with the custom book, the adjacent signature on which the first printer head prints being inside the output group of signatures.*

*42. The collating system of claim 41 wherein the source means contains subscriber information, at least a portion of the subscriber information being printed on the respective adjacent signatures by each printer head.*

*43. The collating system of claim 42 in which the second printer head is located after the plurality of feeder means and the message printed by the second printer head includes mailing information for the subscriber of the custom book.*

* * * * *